US007040712B2

(12) United States Patent
Sakae et al.

(10) Patent No.: US 7,040,712 B2
(45) Date of Patent: May 9, 2006

(54) SHIELD TUNNELING METHOD AND SHIELD TUNNELING MACHINE

(75) Inventors: Takeshi Sakae, Chiba (JP); Shunichi Sonomura, Tokyo (JP); Wataru Naitou, Kanagawa (JP); Hiroyuki Itou, Mie (JP); Takashi Nakane, Aichi (JP); Shuusuke Mizuno, Aichi (JP); Shin Sugimori, Aichi (JP)

(73) Assignees: Taisei Corporation, Tokyo (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 254 days.

(21) Appl. No.: 10/470,435

(22) PCT Filed: Jul. 22, 2002

(86) PCT No.: PCT/JP02/07393

§ 371 (c)(1),
(2), (4) Date: Jul. 28, 2003

(87) PCT Pub. No.: WO03/010416

PCT Pub. Date: Feb. 6, 2003

(65) Prior Publication Data

US 2004/0093768 A1 May 20, 2004

(30) Foreign Application Priority Data

Jul. 23, 2001 (JP) ..... 2001-221872
Jul. 23, 2001 (JP) ..... 2001-221874
Jan. 22, 2002 (JP) ..... 2002-046720

(51) Int. Cl.
*E21B 3/00* (2006.01)
*E21D 9/10* (2006.01)

(52) U.S. Cl. ..... 299/55; 299/61; 405/141

(58) Field of Classification Search ..... 37/189; 299/31, 33, 55, 58, 61; 405/138, 141
See application file for complete search history.

(56) References Cited

U.S. PATENT DOCUMENTS 748,206 A * 12/1903 Mueller ..... 15/104.061
3,814,481 A * 6/1974 Montacie ..... 299/61
3,917,351 A * 11/1975 Pirrie et al. ..... 299/85.2
3,985,390 A * 10/1976 Kojima et al. ..... 299/31
4,248,481 A * 2/1981 Stoltefuss ..... 299/33

(Continued)

FOREIGN PATENT DOCUMENTS

JP 06 173591 6/1994

(Continued)

*Primary Examiner*—Thomas A. Beach
(74) *Attorney, Agent, or Firm*—Oblon, Spivak, McClelland, Maier & Neustadt, P.C.

(57) ABSTRACT

An excavating drive (22) movable backward/forward is accommodated in a turnable body (9) which in turn is turnable about an axis perpendicular to an axis of and in a skin plate (7). A cutter device (38) ahead of a rotor (22) in the excavating drive (22) is composed of a center cutter (40) supported by the excavating drive (22) and a plurality of face plate shaped expansion cutters (44) fitted to an outer periphery of the center cutter (40) for pivotal movement backward/forward. Tunneling is effected by the expanded cutter device with the expansion cutters (44) being pivoted forward. Upon replacement of bits (35; 35'), the expansion cutters (44) are pivoted backward for contraction of an assembly of them and the cutter device (38) is accommodated in a turning trajectory (R) of the turnable body (9) so that the turnable body (9) is turned backward for replacement of the damaged bits (35; 35') backward.

24 Claims, 26 Drawing Sheets

U.S. PATENT DOCUMENTS 4,311,344 A * 1/1982 Akesaka ..... 299/33
4,448,270 A * 5/1984 Buske ..... 175/342
4,805,963 A * 2/1989 Kogler et al. ..... 299/33
5,051,032 A * 9/1991 Bessho et al. ..... 405/141
5,340,199 A * 8/1994 Piefenbrink et al. ..... 299/10
5,547,260 A * 8/1996 Kawai et al. ..... 299/33
5,890,771 A * 4/1999 Cass ..... 299/31
6,612,655 B2 * 9/2003 Schwoebel et al. ..... 299/29

FOREIGN PATENT DOCUMENTS

JP 06 173593 6/1994
JP 07 238783 9/1995
JP 10 008887 1/1998
JP 10 077780 3/1998
JP 02236395 * 9/1999

* cited by examiner

SHIELD TUNNELING METHOD AND SHIELD TUNNELING MACHINE

TECHNICAL FIELD

The present invention relates to a shield tunneling method and a shield tunneling machine, using a face plate type cutter device with bits.

BACKGROUND ART

Continual tunneling of a long-distance tunnel will require replacement of damaged bits on a cutter device with tunneling being halted halfway. In order to comply with such requirement, there has been proposed a shield tunneling machine with a turnable body. This turnable body, which is disposed in a skin plate and ahead of a shield frame, is turnable about an axis perpendicular to an axis of the tunneling machine and accommodates an excavating drive with a cutter device ahead thereof, so that turning of the turnable body causes the cutter device to be directed backward, which facilitates replacement of damaged bits on the cutter device backward with tunneling being halted halfway; in this respect, words such as "forward", "backward", "front" and "rear" in the specification are referred to in relation with a direction of tunneling unless otherwise specified. Thus, tunneling for a long distance can be attained with damaged bits being replaced halfway of tunneling.

FIGS. 1 through 3 show a conventional shield tunneling machine comprising a shield body 1 with front and rear skin plates 7 and 2. The rear skin plate 2 has a front end within which a shield frame 3 is integrally arranged. The shield frame 3 has a number of shield jacks 4 which are arranged along an inner periphery of the rear skin plate 2 and which can be expanded to advance the shield body 1, using reaction force from segments S. Mounted on the shield frame 3 is means 5 for erecting the segments S.

The front skin plate 7, which is divertible by actuation of some of circumferentially arranged jacks 6 to change the direction of tunneling, is fitted to the rear skin plate 2 such that the former may be bent relative to the latter at their connection upon such change of the direction of tunneling.

In the front skin plate 7, there is provided a turnable shield device 8 with a turnable body 9 in the shape of for example sphere and having a turning trajectory R in the front skin plate 7. In the turnable body 9, there is provided a cylindrical wall 11 which extends longitudinally of the shield body 1 with its axis passing through a center of the turnable body 9 and which has a front annular end opened at 10 to thereby provide a cylindrical space 12. The turnable body 9 is turnably fitted via bearings 14 over shafts 13 which in turn are attached to the inner periphery of the skin plate (above and below in FIG. 1) and which have a common axis passing through the center of the turnable body 9 and perpendicular to the axis of the cylindrical wall 11 or of the shield body 1.

As shown in FIG. 3, the turnable body 9 has a plurality of pins 15 which are fixed to an outer periphery of the turnable body 9 circumferentially and equidistantly around each of the shafts 13. For each of the shafts 13, two jacks 16 extend substantially in parallel with each other and oppositely with respect to the shaft 13 as shown in FIG. 3 and are pivotally connected at their ends away from their rods to the inner periphery of the front skin plate 7. Each of rods of the jacks 16 has a catching part 17 engageable with the pin 15. Repeated expansion and contraction of one of the jacks 16 causes the pins 15 to be sequentially pushed by the catching part 17 of the one jack 16 with a result that the turnable body 9 is turned about the shaft 13 as shown by a curved arrow in FIG. 3 by, say, 180°. Repeat d expansion and contraction of the other jack 16 causes the pins 15 to be sequentially pushed by the catching part 17 of the other jack 16 with a result that the turnable body 9 is turned about the shaft 13 in a direction reverse to the above by, say, 180°. As shown in FIG. 1, the front skin plate 7 has a rear end to which a bulkhead 18 with a work port 19 is secured to enclose the turnable body 9 at its back along the turning trajectory R.

In the cylindrical wall 11, there is provided an excavating drive 22 which has a covering or cylinder 21 and is shielded at its front surface by a rotor 20 rotating around the axis of the wall 11 and a face plate 20*a* surrounding the rotor 20.

Arranged ahead of the rotor 20 is a cutter device 24 which is connected to the excavating drive 22 in a spaced-apart relationship via connecting members 23*a*. The cutter device 24 is rotatively driven via a drive center shaft 23 by a rotary drive motor 25 fixed at the axis of the cylindrical wall 11. The cutter device 24, together with the excavating drive 22 and the skin plate 7, defines a cutter chamber 24*a*. The rotor 20 has a man lock 26 which allows an operator to access the cutter chamber 24*a*. The face plate 20*a* is provided with slurry delivery and discharge pipes 27 and 28.

The excavating drive 22 is connected to a rear of the turnable body 9 by sliding jacks 29 such that the excavating drive 22 is movable axially of and along the cylindrical wall 11 by expansion and contraction of the sliding jacks 29. Reference numeral 30 denotes a spacer arranged between the turnable body 9 and the cylinder 21.

The front skin plate 7 has a front end with an inner circular seal 31 which contacts a spherical portion 9*a* of the turnable body 9 adjacent to the opening 10 to prevent soil and ground water from intruding backward.

As shown in FIGS. 1 and 2, the cutter device 24 has a plurality of (six in FIG. 2) short, radially extending, inner cutter spokes 32 each of which is fixed to the drive center shaft 23 and has a telescopic cutter spoke 34 which in turn can be radially expanded and contracted by an expansion jack 33 accommodated in the inner cutter spoke 32, a tip end of the telescopic cutter spoke 34 being substantially aligned with an outer diameter of the skin plate 7 when the telescopic cutter spoke 34 is expanded maximum. The cutter spokes 32 and 34 have a number of fixed bits 35. Each of the telescopic cutter spokes 34 has a tip end with a copy cutter 37 which is projectable and retrojectable by an expansion jack 36.

The cutter spokes 32 and 34 of the cutter device 24 are shown in FIGS. 1 and 2 to have the fixed bits 35; however, they may be provided with any kinds of bits such as roller bits.

FIG. 1 shows a state of being tunneled with the axis of the shield body 1 being aligned with that of the excavating drive 22, the cutter device 24 being increased in size or diameter through expansion of the expansion jacks 33 and thus of the telescopic cutter spokes 34.

Replacement of damaged bits 35 on the cutter device 24 will be described, starting from such state of being tunneled.

First, tunneling is halted. Then, required are reduction in diameter or contraction of the cutter device 24 into a size accommodable in the turning trajectory R and subsequent turning of the turnable body 9 to direct the cutter device 24 backward. These are carried out as follows.

In the state shown in FIGS. 1 and 2 and with tunneling being halted, the expansion jacks 33 are contracted to retract the telescopic cutter spokes 34 into the inner cutter spokes 32 and then the expansion jacks 36 are contracted to retract the copy cutters 37, thereby reducing the outer diameter of or contracting the cutter device 24. However, as may be readily seen from FIG. 1, even with the cutter device 24 being contracted, the inner cutter spokes 32 still protrude outside the turning trajectory R.

On this account, then, the spacer 30 is removed to release the engagement between the turnable body 9 and the cylinder 21 of the excavating drive 22. Then, the slurry delivery and discharge pipes 27 and 28 and the like are removed and the sliding jacks 29 are contracted to move the excavating drive 22 backward along the cylindrical wall 11 with a result that all of the cutter device 24 and the excavating drive 22 are within the turning trajectory R.

Then, the jacks 16 shown above and blow in FIG. 1 are repeatedly expanded and contracted to turn the turnable body 9 around the shafts 13 by 180° to direct the excavating drive 22 and the cutter device 24 backward. During such turning of the turnable body 9, contact between the spherical portion 9*a* and the seal 31 is once released, resulting in intrusion of ground water into backward of the turnable body 9; however, completion of the turning by 180° will bring about re-contact and re-sealing between the spherical portion 9*a* and the seal 31.

The ground water intruding into between the turnable body 9 and the bulkhead 18 is discharged through the work port 19 to dry the rear of the excavating drive 22: then, an operator enters forward of the bulkhead 18 through the work port 19 and replaces the damaged bits 35 on the cutter device 24 in a dry environment. In this chance, for example, repair of the cutter spokes 32 and 34 may be effected.

After the replacement of the damaged bits 35 on the cutter device 24, the turnable body 9 is turned about in a manner reverse to the above to re-direct the cutter device 24 forward; then, the sliding jacks 29 are expanded to advance the excavating drive 22 into a position where the front end of the front skin plate 7 may not be interfered with the telescopic cutter spokes 34 when the latter are expanded. Then, the telescopic cutter spokes 34 are expanded to increase in diameter or expand the cutter device 24. Then, tunneling is re-started.

As mentioned above, the turning of the turnable body 9 with the excavating drive 22 accommodated therein about the axis perpendicular to the axis of the skin plate 7 or of the shield body 1 so as to replace the damaged bits 35 on the cutter device 24 backward or backstage will assure safe and efficient replacement of the damaged bits 35 in a dry environment.

However, as mentioned above, the turning of the turnable body 9 about the axis perpendicular to the axis of the skin plate to direct the cutter device 24 backward requires reducing in diameter or contracting the cutter device 24 to a size accommodable in the turning trajectory R of the turnable body 9. On this account, the cutter device 24 in the conventional rotary shield device 8 has a requisite of having cutter spokes such as the cutter spokes 32 and 34.

This greatly restricts grounds which may be tunneled by a conventional shield tunneling machine with a rotary shield device.

More specifically, for the grounds with their faces readily collapsible by a slurry-shielding tunneling machine, tunneling must be effected by a shield tunneling machine having a face plate type cutter device with the faces of the grounds being held by the face plate. For tunneling of conglomerate layers, size of pebbles to be taken in must be controlled by take-in slots on a face plate. Also for tunneling of bedrock, a face plate with take-in slots is needed to control sizes of masses of rocks to be taken in. Thus, a cutter device with a face plate is often required depending upon conditions of grounds to be tunneled.

However, as mentioned above, the rotary shield device 8 which enables the damaged bits 35 to be replaced backward requires to have the cutter device 24 contractible into a size accommodable in the turning trajectory R of the turnable body 9. Conventionally, a face plate type cutter device cannot be reduced in diameter or contracted in size and therefore only the spoke type cutter device as mentioned above can be employed.

Thus, a conventional shield tunneling machine with a rotary shield device has a drawback that, for grounds which require tunneling with a face plate type cutter device, it cannot effect long-distance tunneling with damaged bits on a cutter device being replaced halfway of tunneling.

DISCLOSURE OF THE INVENTION

The invention has its object to provide a shield tunneling method and a shield tunneling machine wherein a cutter device is expandable and contractible though it is of a face plate type, the cutter device being contracted to make a turnable body with the cutter device accommodated therein turnable about an axis perpendicular to an axis of a skin plate, the cutter device being expanded to effect stable tunneling. Long-distance tunneling can be effected, even if tunneling is hindered by damages on bits, by replacement of such damaged bits through contraction and turning of the cutter device.

The invention provides a shield tunneling method and a shield tunneling machine wherein a rotary shield device comprises a turnable body turnable about an axis perpendicular to an axis of and in a skin plate, an excavating drive movable backward/forward in the turnable body and a cutter device ahead of a rotor of the excavating drive, the cutter device being contracted to be accommodated in the turnable body which is turned about the axis perpendicular to the axis of the skin plate to make damaged bits on the cutter device replaceable backward, characterized in that the cutter device comprises a center cutter supported by the excavating drive and a plurality of face plate type expansion cutters pivotally mounted to an outer periphery of the center cutter such that they may be pivoted backward/forward, tunneling being effected by the cutter device enlarged or expanded through forward pivotal movement of the expansion cutters whereas, upon replacement of damaged bits, the cutter device is contracted into a size accommodable in a turning trajectory of the turnable body with the expansion cutters being pivoted backward, and then the turnable body is turned about the axis perpendicular to the axis of the skin plate for replacement of the bits backward.

BEST MODE FOR CARRYING OUT THE INVENTION

Figure 1:
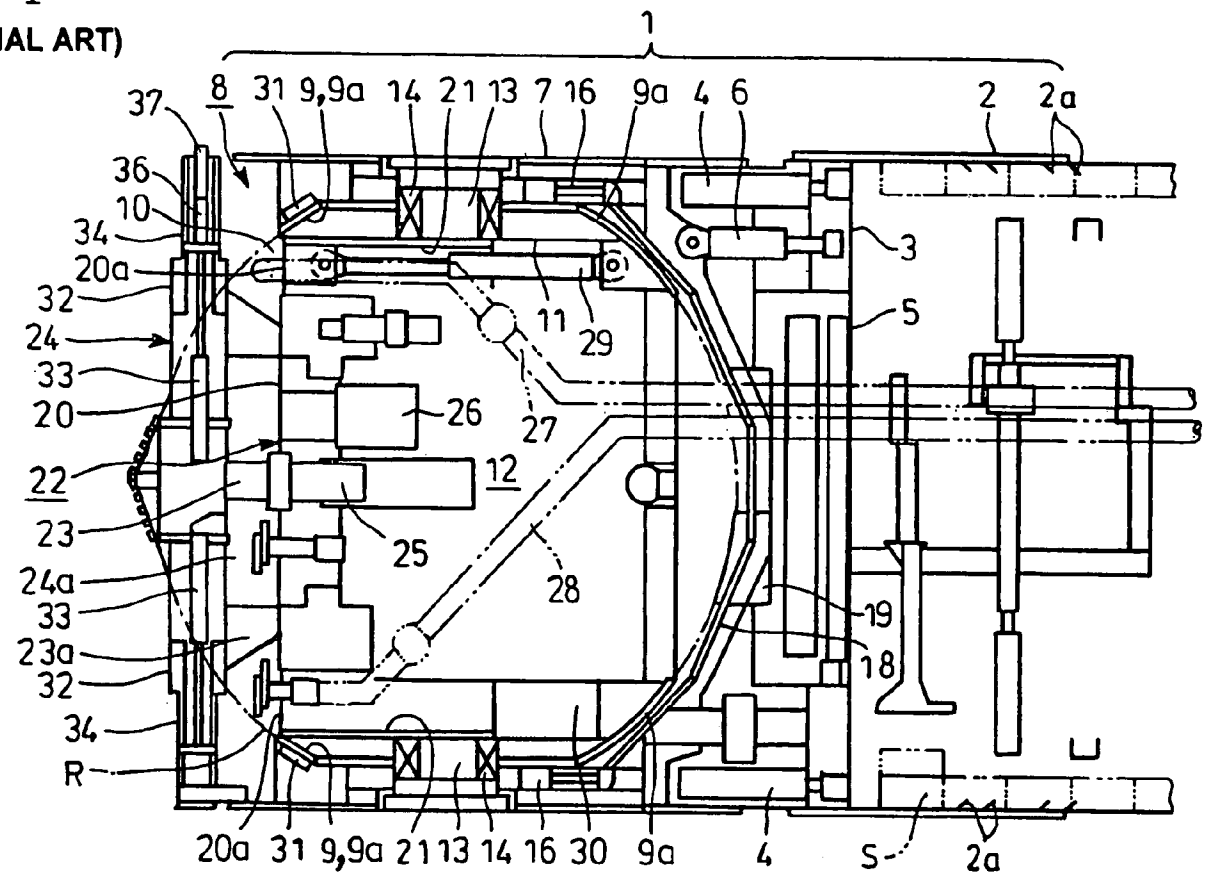
FIG. 1 (CONVENTIONAL ART)
FIG. 1 is a side view in section of a conventional shield tunneling machine with a rotary shield device.

Preferred embodiments of the invention will be described in conjunction with the drawings. In the embodiments described hereinafter, parts and components similar to those in FIGS. 1 through 3 or mutually similar in the respective embodiments are designated by the same reference numerals and repeated explanation thereon is omitted. Only characteristic features of the invention will be described in detail.

Figure 4:
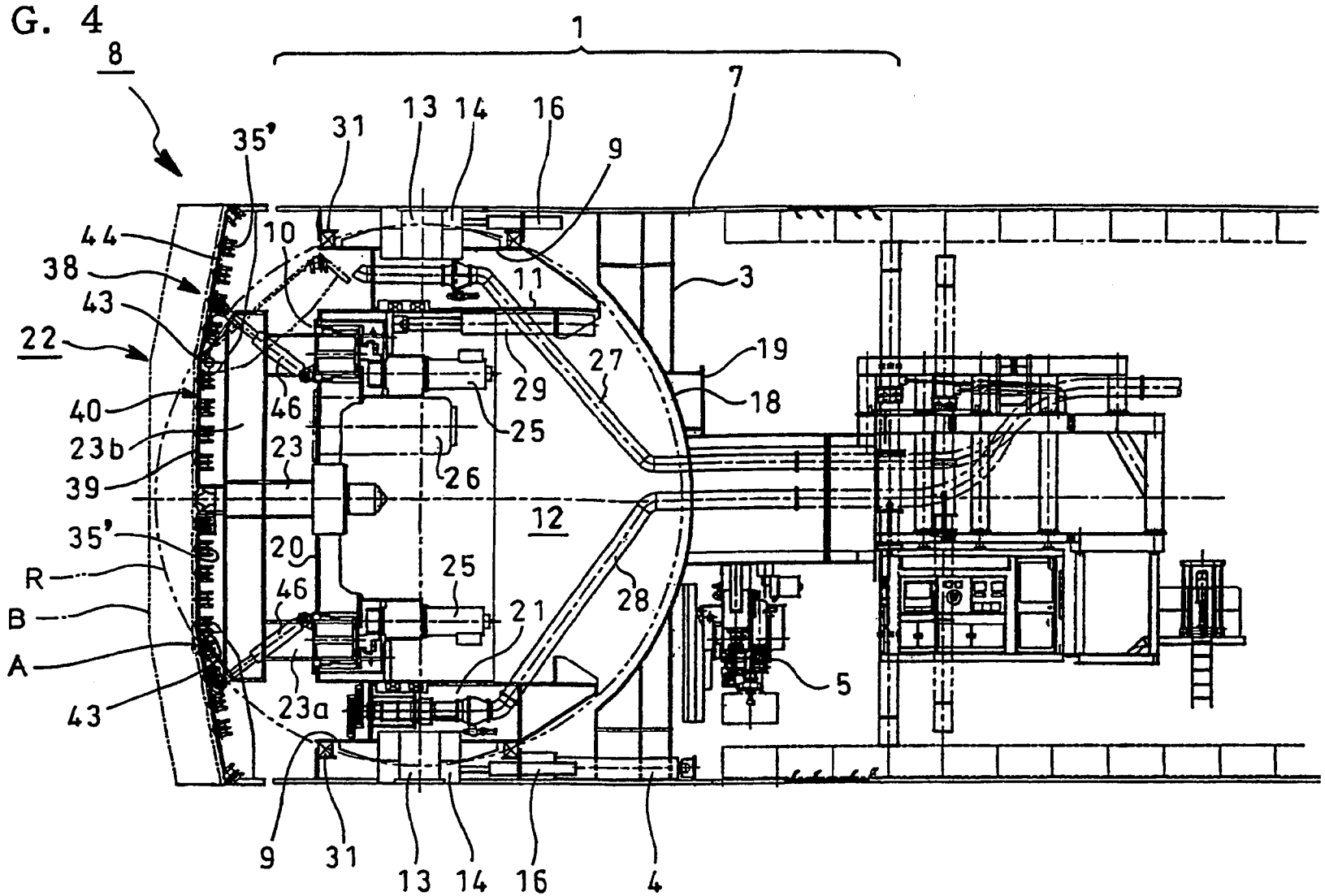
FIG. 4 is a side view in section of a shield tunneling machine according to a first embodiment of the invention.
Figure 5:
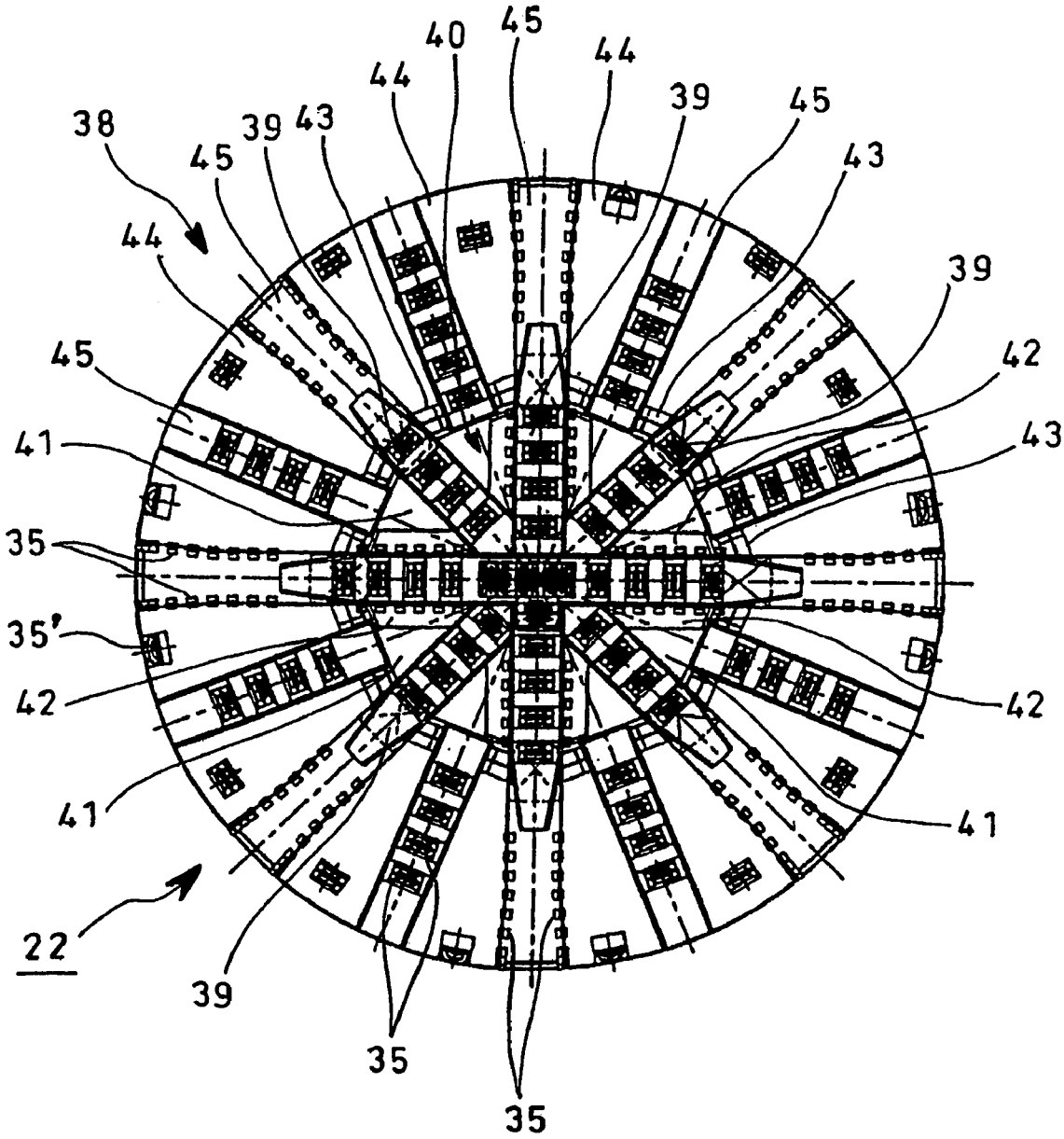
FIG. 5 is a front view of a cutter device shown in FIG. 4.

FIGS. 4 and 5 show a first embodiment of a shield tunneling machine according to the invention in which a shield body 1 is illustrated to have a single skin plate 7; of course, it may alternatively have rear and front skin plates bendable at their connection just like the shield body 1 shown in FIG. 1. It is to be understood that the invention may have any type of shield body provided that a skin plate or plates have therein a turnable body in which an excavating drive is accommodated. The description will be made on the turnable body in the form of sphere; however, the turnable body may be of any shape such as a cylinder or a tube with a polygonal contour provided that it is turnable perpendicularly of the skin plate.

Figure 2:
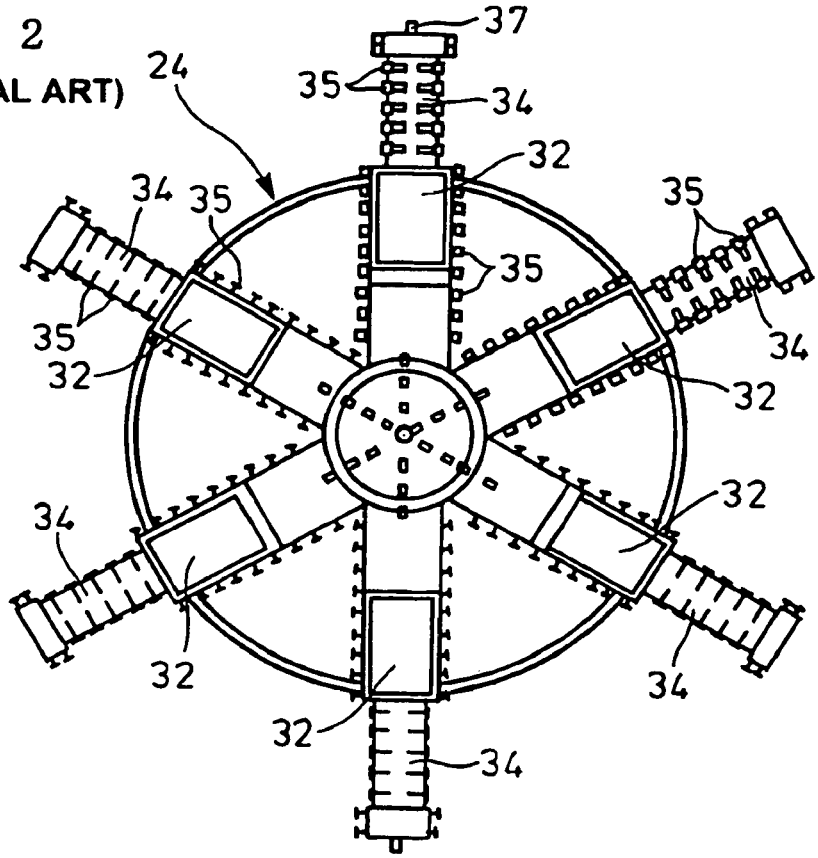
FIG. 2 (CONVENTIONAL ART)
FIG. 2 is a front view of a cutter device shown in FIG. 1.

According to the first embodiment shown in FIGS. 4 and 5, a rotary shield device 8 has an excavating drive 22 with a cutter device 38 structurally different from the conventional cutter device 24 shown in FIGS. 1 and 2.

More specifically, disposed ahead of a rotor 20 rotated by a rotary drive motor 25 of an excavating drive 22 is a fixed member 23*b* which is fixed in a spaced-apart relationship to the rotor 20 through connecting members 23*a*. Disposed ahead of and fixed to the fixed member 23*b* is a center cutter 40 which has a plurality of (eight in FIG. 5) radially extending, short cutter frames 39. The center cutter 40 is designed, as shown in FIG. 4, to a size accommodable in a turning trajectory R of the turnable body 9. The center cutter 40 also has small face plates 41 each between the adjacent cutter frames 39. Each of alternate four of the cutter frames 39 has, at its opposite sides, take-in slots 42 provided by notching the face plates 41.

The cutter frames 39 are interconnected adjacent to their tip ends by substantially circumferentially extending shafts 43 over each of which is fitted a substantially fan-shaped face plate type expansion cutter 44 such that it may be pivoted backward/forward about the shaft 43.

When each of the expansion cutters 44 is pivoted backward as shown in two-dot-chain lines in FIG. 4, an assembly of the expansion cutters 44 is reduced in its apparent diameter seen from forward (see FIG. 6) or contracted in size or height into a size accommodable in the turning trajectory R whereas, when each of the expansion cutters 44 is pivoted forward as shown in solid lines in FIG. 4, the assembly of the expansion cutters 44 is enlarged in its apparent diameter seen from forward (see FIG. 5) or expanded into a size substantially in alignment with the outer diameter of the skin plate 7. The assembly of the expansion cutters 44 has take-in slots 45 between the cutters 44 as shown in FIG. 5.

Attached to a front surface of the rotor 20 of the excavating drive 22 at circumferentially equidistant positions around an axis of the rotor 20 are one ends of expansion drives 46 in the form of for example hydraulic expansion jacks; the one ends of the expansion drives 46 are positioned closer to the axis of the shield body 1 than the other ends thereof so that the expansion drives 46 extend obliquely or forward and outward to be connected at the other ends to the corresponding expansion cutters 44, respectively. Expansion and contraction of the expansion drives 46 cause the expansion cutters 44 to be pivoted forward and backward to expand and contract the assembly of the expansion cutters 44 as a whole into enlarged and reduced sizes, respectively.

The expansion drives 46 may serve as stoppers through, for example, hydraulic cutoff for the purpose of preventing the forwardly pivoted expansion cutters 44 from being pivoted back so as to support tunneling load. For prevention of the forwardly pivoted cutters 44 from being pivoted back, any other means may be employed such as stopper members (not shown) protruded from the rotor 20; alternatively, the expansion drives 46 may be in the mechanical form of for example screw shafts or link mechanisms to prevent the forwardly pivoted expansion cutters 44 from being pivoted back.

In FIGS. 4 and 5, the cutters 40 and 44 have roller type bits 35' while the take-in slots 45 provided by the cutters 44 have fixed bits 35; the cutters 40 and 44 and the slots 45 may have various kinds of bits.

Next, mode of operation of the first embodiment will be described.

FIG. 4 shows a state of being tunneled with the axis of the shield body 1 being aligned with that of the excavating drive 22 accommodated in the rotary shield device 8, the assembly of the expansion cutters 44 being expanded with the cutters 44 being pivoted forward, the shield jacks 4 being expanded to advance the shield body 1. In this case, the cutter device 38 is generally of a face plate shape provided by the center cutter 40 and expansion cutters 44 and tunneling can be effected with take-in of soil, pebbles and/or masses of rocks being controlled in size through take-in slots 45 and 42 on the cutter device 38.

Replacement of the damaged bits 35 and 35' on the cutter device 38 will be described, starting from the state of being tunneled.

First, tunneling is halted. Then, required are contraction in size or height of the cutter device 38 into a size accommodable in the turning trajectory R of the turnable body 9 and subsequent turning of the turnable body 9 to direct the cutter device 38 backward. These are carried out as follows.

In a position A shown by solid lines in FIG. 4 and with tunneling being halted, the cutter device 38 is rotatively driven and the sliding jacks 29 are expanded to advance the excavating drive 22 from the position A to a position B shown by two-dot-chain lines within which the turning trajectory R can be embraced, thereby effecting a precedent tunneling operation from the position A to the position B.

Figure 6:
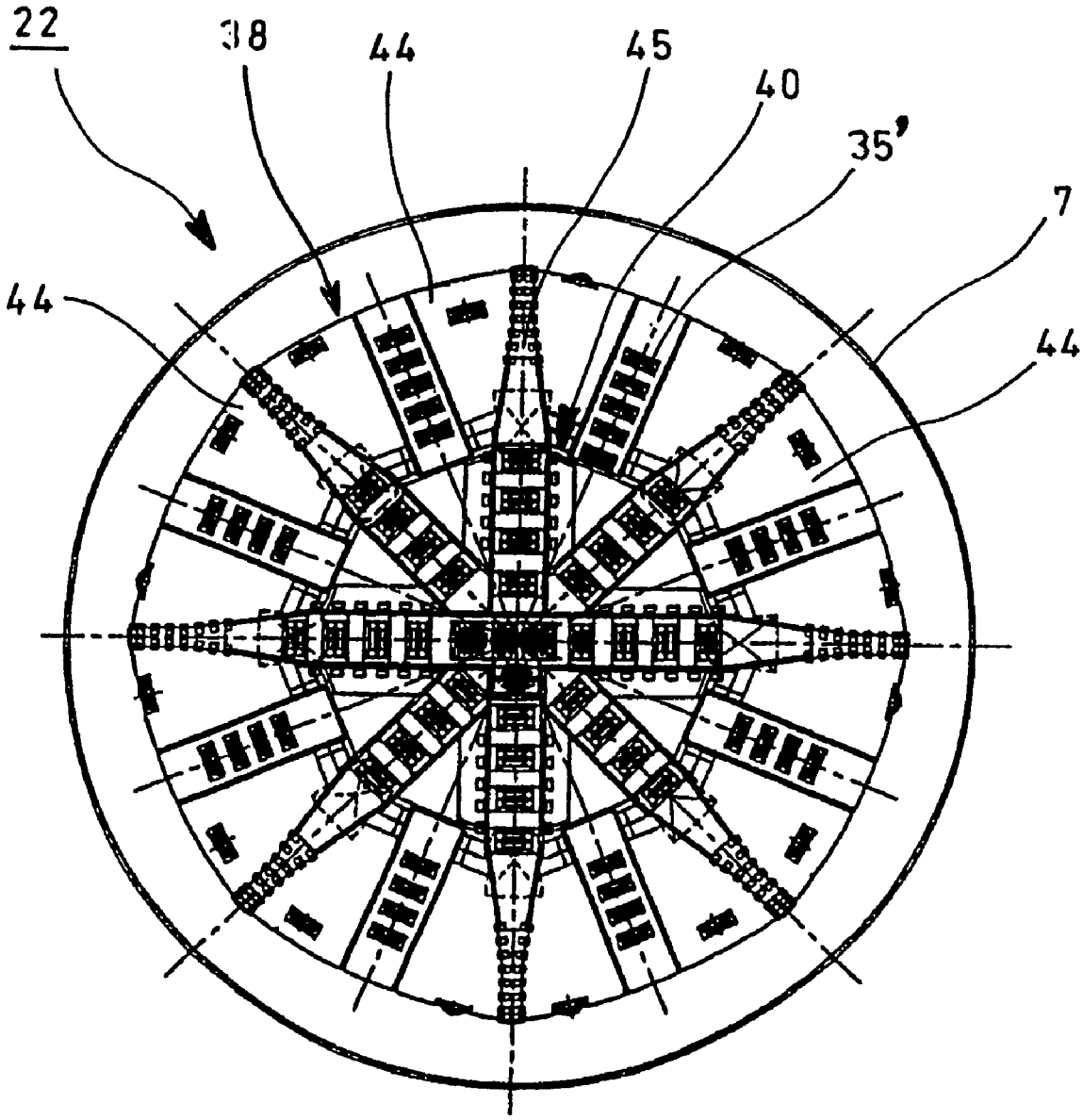
FIG. 6 is a front view of the cutter device shown in FIG. 4 in a state of being contracted.

Upon completion of the precedent tunneling operation, the expansion drives 46 are contracted to pivot the expansion cutters 44 backward. Thus, the assembly of the expansion cutters 44 is reduced in apparent diameter or height or contracted as shown in FIG. 6. Then, the sliding jacks 29 are contracted to retract the excavating drive 22 backward, thereby retracting back the cutter device 38 into the position A shown in FIG. 4. Thus, all of the cutter device 38 and the excavating drive 22 are within the turning trajectory R of the turnable body 9. In the above-mentioned contraction of the assembly of the expansion cutters 44, each of the cutters 44 can be pivoted backward with no hindrance owing to the slots 45 between the expansion cutters 44. Then, the slurry delivery and discharge pipes 27 and 28 and the like are dismounted.

Figure 3:
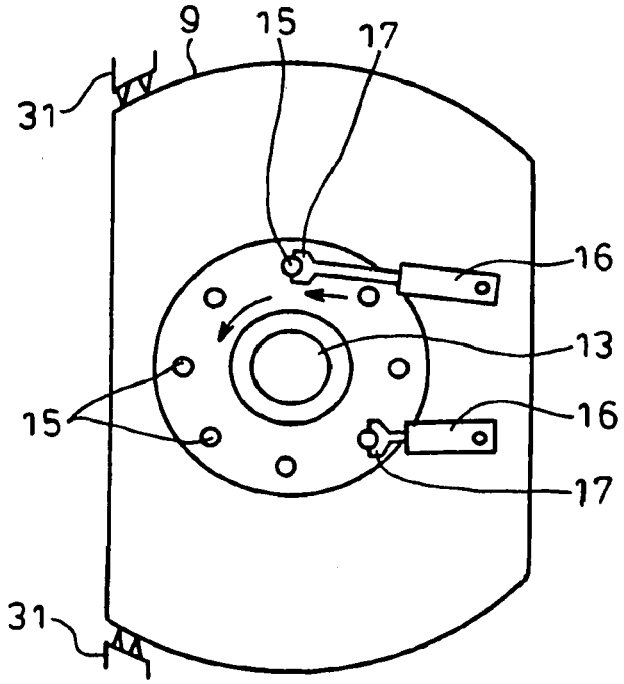
FIG. 3 (CONVENTIONAL ART)
FIG. 3 is a plan view of an embodiment of jacks for turning a turnable body.
Figure 7:
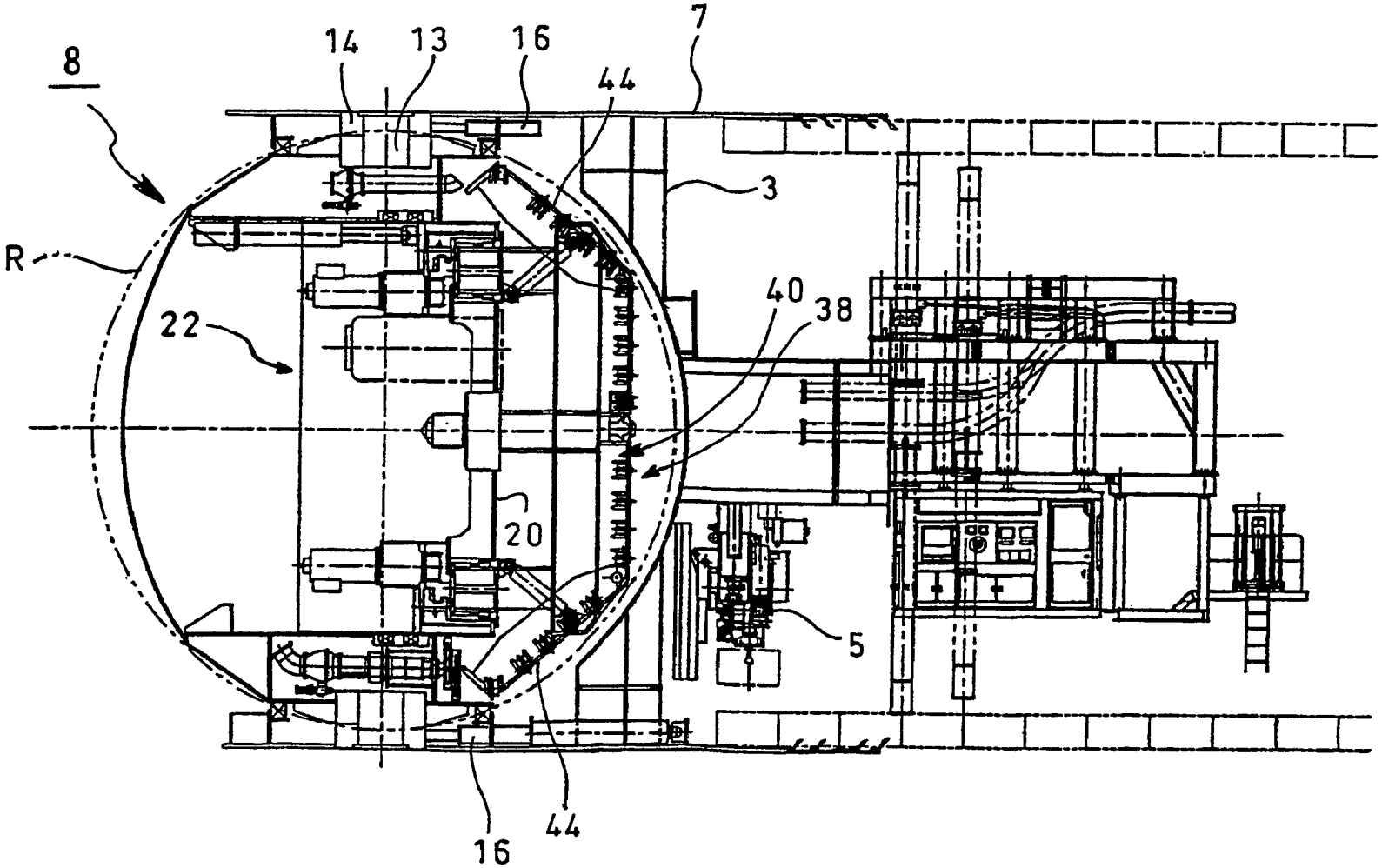
FIG. 7 is a side view in section of the cutter device shown in FIG. 4 in a state of being accommodated in the turnable body and turned backward.

Then, the jacks 16 as shown in FIGS. 3 and 4 are actuated to turn the turnable body 9 around the shafts 13 by about 180° to direct the cutter device 38 backward as shown in FIG. 7. During such turning of the turnable body 9, contact between the turnable body 9 and the seal 31 is once released, resulting in intrusion of ground water backward of the turnable body 9; however, completion of the turning by 180° will bring about re-contact and re-sealing between the turnable body 9 and the seal 31.

The ground water intruding into between the turnable body 9 and the bulkhead 18 is discharged through the work port 19 to dry the rear of the excavating drive 22 on which the cutter device 38 is positioned; then, an operator enters forward of the bulkhead 18 through the work port 19 and replaces the damaged bits 35 and 35' on the cutter device 38 in a dry environment. In this chance, for example, repair of the cutters 40 and 44 may be carried out. Thus, the turning of the cutter device 38 and excavating drive 22 backward through the turning of the turnable body 9 for replacement of the damaged bits 35 and 35' on the cutter device 38 backward will assure safe and efficient replacement of the damaged bits in a dry environment.

As mentioned above, the cutter device 38 is composed of the center cutter 40 and the expansion cutters 44 fitted to the outer periphery of the center cutter 40 such that the expansion cutters 44 may be pivoted backward/forward. Therefore, the cutter device 38, which is of a face plate shape, can be contracted into a size accommodable in the turning trajectory R of the turnable body 9 so that the excavating drive 22 can be turned backward for replacement of the damaged bits 35 and 35'; when the cutter device 38 is expanded in size, tunneling can be effected with take-in of soils, pebbles and/or masses of rocks through the take-in slots 45 and 42 of the cutter device 38 being controlled in size.

Thus, with respect to grounds which require tunneling with a face plate type cutter device, long-distance tunneling can be effected, using the rotary shield device 8 with the face plate type cutter device 38, the damaged bits 35 and 35' being replaced halfway of tunneling with tunneling being halted. This will drastically expand a scope of application of the shield tunneling machine with the turnable body 9 and excavating drive 22.

FIGS. 8 through 11 show a second embodiment of a shield tunneling machine according to the invention.

Figure 8:
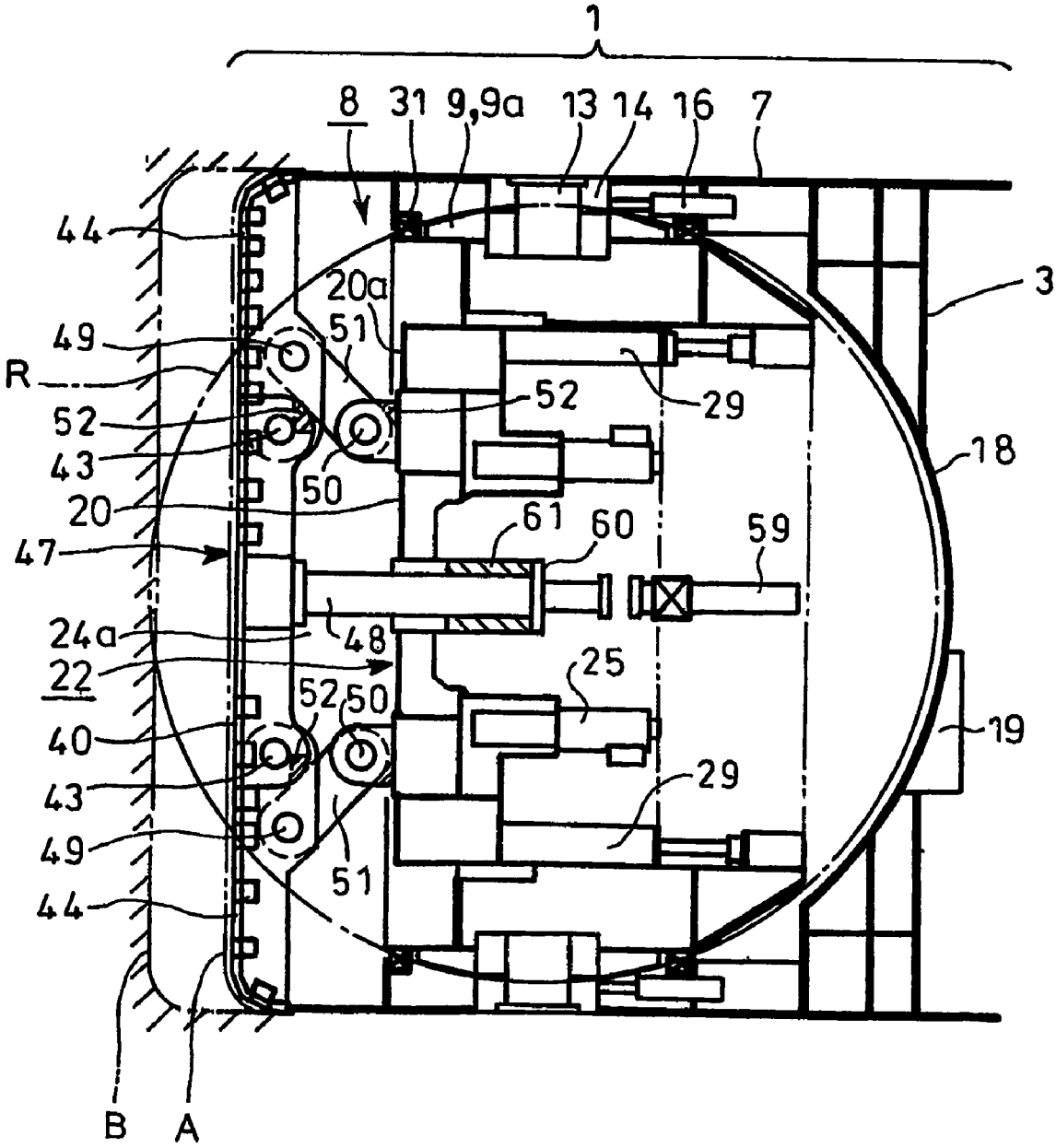
FIG. 8 is a side view in section of a shield tunneling machine according to a second embodiment of the invention.
Figure 9:
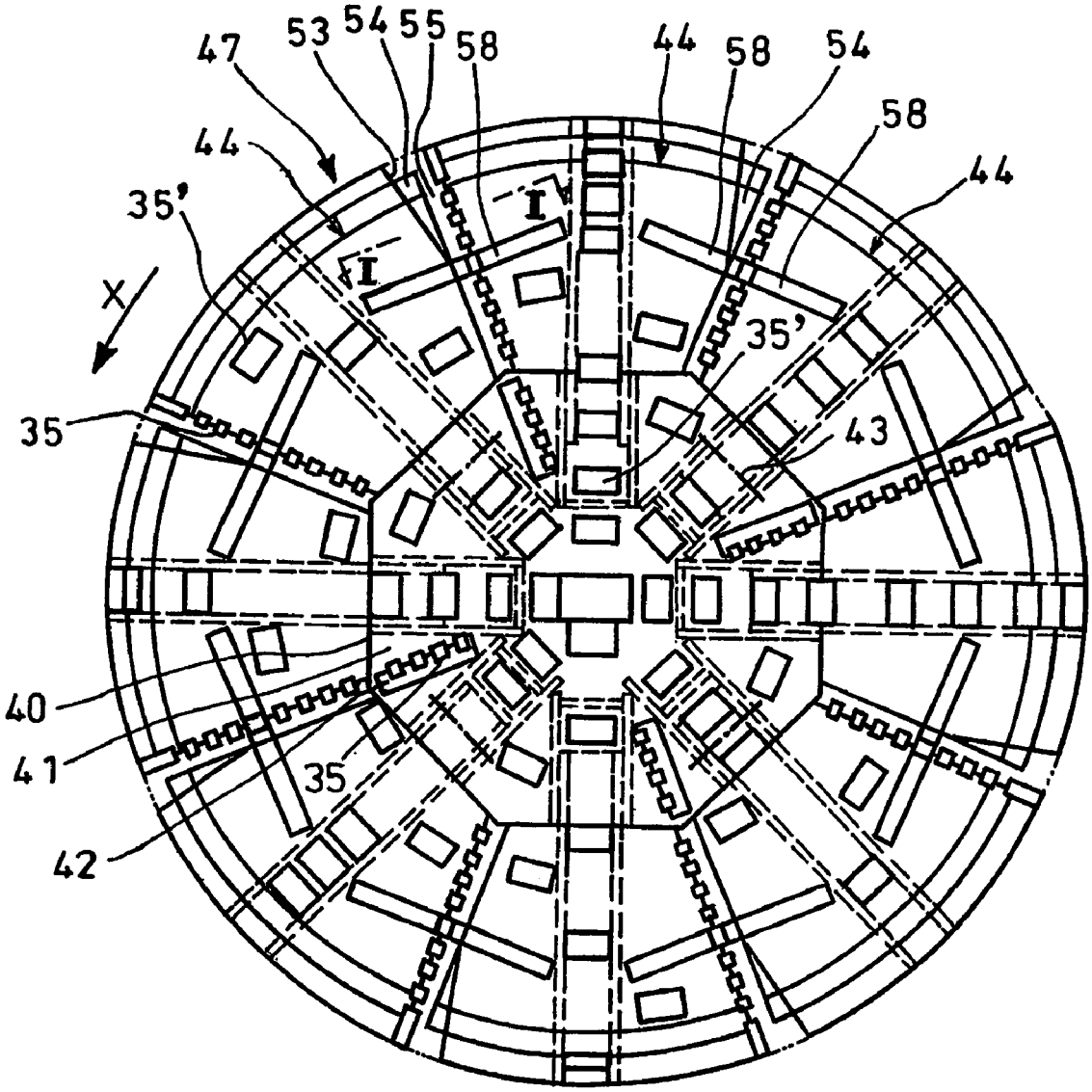
FIG. 9 is a front view of a cutter device shown in FIG. 8.

The second embodiment has, as shown in FIGS. 8 and 9, a cutter device 47 which is ahead of an excavating drive 22 and which has a center shaft 48 movable backward/forward. The center shaft 48 has a rear end passing through the rotor 20 of the excavating drive 22 as well as a front end to which is fixed a face plate type center cutter 40 with a polygonal counter (an octagonal counter in FIG. 9). The center cutter 40 is shaped to be accommodated in the turning trajectory R of the turnable body 9 when it is retracted toward the excavating drive 22 as shown in FIG. 8. Alternatively, the center cutter 40 may have radially extending cutter frames 39 and substantially triangular face plates 41 with take-in slots 42 between the cutter frames 39 as shown in FIG. 5.

The polygonally countered center cutter 40 has outer edges having shafts 43 extending along the edges, respectively. Fitted to each of the shafts 43 is a substantially fan-shaped face plate type expansion cutter 44 such that it may be pivoted backward/forward about the shaft 43.

Each of the expansion cutters 44 has on its back a pin 49 connected through a link beam 51 to a corresponding pin 50 arranged on a front surface of the rotor 20 of the excavating drive 22. The pins 50, which are arranged circumferentially equidistantly around the axis of the center shaft 48, are positioned closer to the axis of the shield body 1 than the pins 49 so that the link beams 51 extend slantingly or forward and outward from the front surface of the rotor 20 to the expansion cutters 44.

Arranged on at least either of rear surfaces of the expansion cutters 44 or the front surface of the rotor 20 (both in FIG. 8) are stopper means in the form of abutment members 52 abutting on the link beams 51. The abutment members 52 can arrest, in cooperation with a spacer 61 mentioned hereinafter, bilateral pivotal movement of the link beams 51 to prevent the expansion cutters 44 from being pivoted backward when the assembly of the expansion cutters 44 is expanded with the link beams 51 being slant maximum to the axis of the shield body 1.

Figure 10:
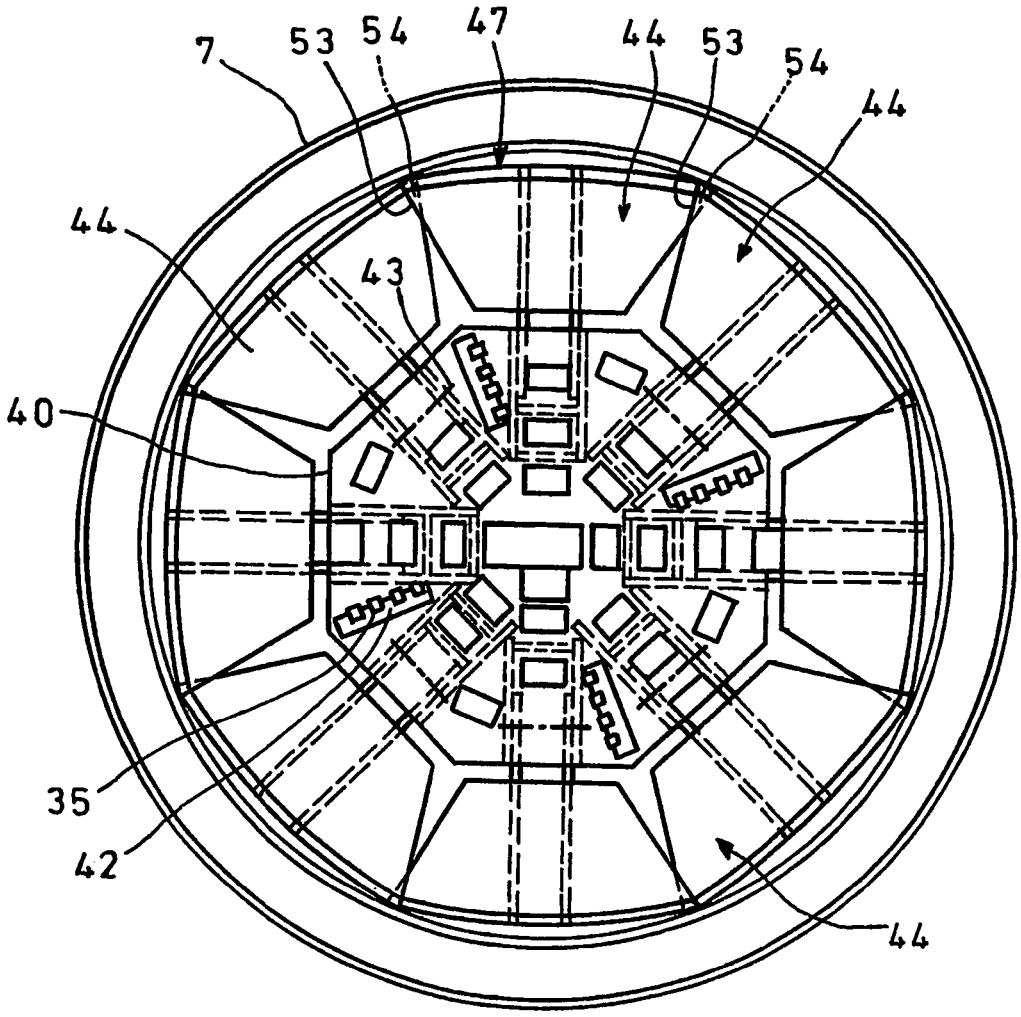
FIG. 10 is a front view of the cutter device shown in FIG. 8 in a state of being contracted.

As shown in FIG. 9, each of the expansion cutters 44 is peripherally notched at 53 on its rear end in a rotative direction X of the cutter device 47 and has a side protrusion 54 fixed to the notched end. The peripheral notches 53 serve to prevent the expansion cutters 44 from being mutually interfered when they are pivoted backward for contraction of the assembly thereof as shown in FIG. 10. Each of the side protrusions 54 serves to form narrow take-in slots 55 between the expansion cutters 44 when they are pivoted forward for expansion of the assembly thereof. Each of the side protrusions 54 is adapted to be overlapped behind a front end of the adjacent expansion cutter 44 in the rotative direction X (FIG. 9) of the cutter device 47 so as to prevent interference with the adjacent cutter 44 when the expansion cutters 44 are pivoted backward for contraction of the assembly thereof as shown in FIG. 10.

Figure 11:
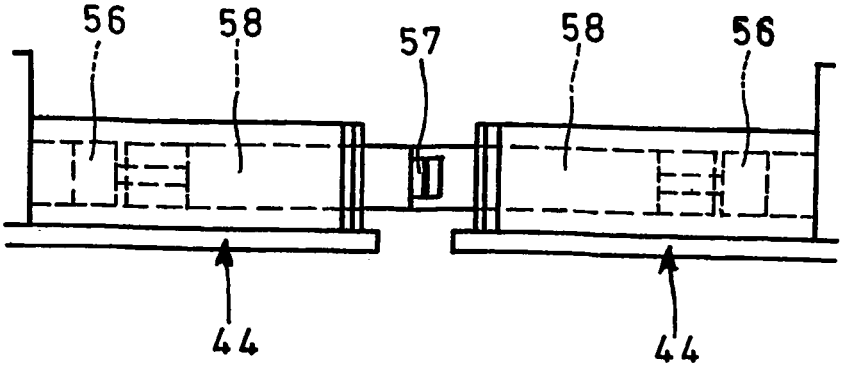
FIG. 11 is a view looking in the direction of arrows I in FIG. 9.

As shown in FIGS. 9 and 11, each of the expansion cutters 44 has stopper means in the form of connectors 58 each of which has a male or female component 57 at its tip end and is expandable for example by a jack 56 into engagement with the complementary female or male component 57 of the corresponding connector 58 of the adjacent expansion cutter 44 so as to attain interconnection between the expansion cutters 44.

As shown in FIG. 8, the excavating drive 22 has therein a thrust jack 59 by which the center shaft 48 may be pushed forward to move the cutter device 47 away from the excavating drive 22. The cutter device 47 may be constrained in a position adjacent to the excavating drive 22 by fitting the spacer 61 over the center shaft 48 between a flange 60 on the center shaft 48 and the rotor 20 of the excavating drive 22.

Next, the mode of operation of the second embodiment will be described.

FIG. 8 shows a state of being tunneled with the axis of the shield body 1 being aligned with that of the excavating drive 22, the spacer 61 being fitted over the center shaft 48 for constraining the cutter device 47 in position adjacent to the excavating drive 22, the expansion cutters 44 being pivoted forward by the link beams 51 for expansion of the assembly of the cutters 44, shield jacks (not shown) being expanded to advance the shield body 1 for tunneling.

During such tunneling, with the spacer 61 being fitted over the center shaft 48, the stopper means in the form of the abutment members 52 abut on the link beams 51 slant maximum to thereby prevent the link beams 51 from being bilaterally pivoted into less slant positions, thus preventing the expansion cutters 44 from being pivoted backward by reaction force from tunneling.

Moreover, the stopper means comprising the connectors 58 on the expansion cutters 44 shown in FIGS. 9 and 11 are expanded to be integrally interconnected with their male and female components 57 being engaged with each other, with a result that the expansion cutters 44 are integrally interconnected into a face plate shape. This also prevents the expansion cutters 44 from being pivoted backward by the reaction force from tunneling. Thus, the rotary drive motor 25 is driven to rotate the cutter device 47 through the link beams 51 with a result that the expansion cutters 44 are rotated in one and the same trajectory, thereby effecting stable tunneling.

During tunneling as shown in FIG. 9, each of the side protrusions 54 on the expansion cutters 44 provides, together with the adjacent expansion cutter 44, the narrow take-in slot 55. Using such take-in slots 55 between the cutters 44 and the take-in slots 42 on the center cutter 40, tunneling can be effected with take-in of soils, pebbles and/or masses of rocks being controlled in size. Thus, a shield tunneling machine according to the invention can be applied to various kinds of grounds to be tunneled, using a face plate type cutter device.

The assembly of the expansion cutters 44 can be expanded and contracted through the link beams 51 by relatively moving the cutter device 47 and the excavating drive 22 toward and away from each other so that no drives such as jacks for expanding the expansion cutters 44 are needed to be provided in the cutter chamber 24*a* and thus no problems are caused such as damages of such drives, which lead to reliable expansion and contraction of the expansion cutters 44.

Replacement of the damaged bits 35 and 35' on the cutter device 47 will be described, starting from the state of being tunneled as mentioned above.

First, tunneling is halted. Then, required are reduction in size or contraction of the cutter device 47 into a size accommodable in the turning trajectory R of the turnable body 9 and subsequent turning of the turnable body 9 to direct the cutter device 47 backward. These are carried out as follows.

Figure 12:
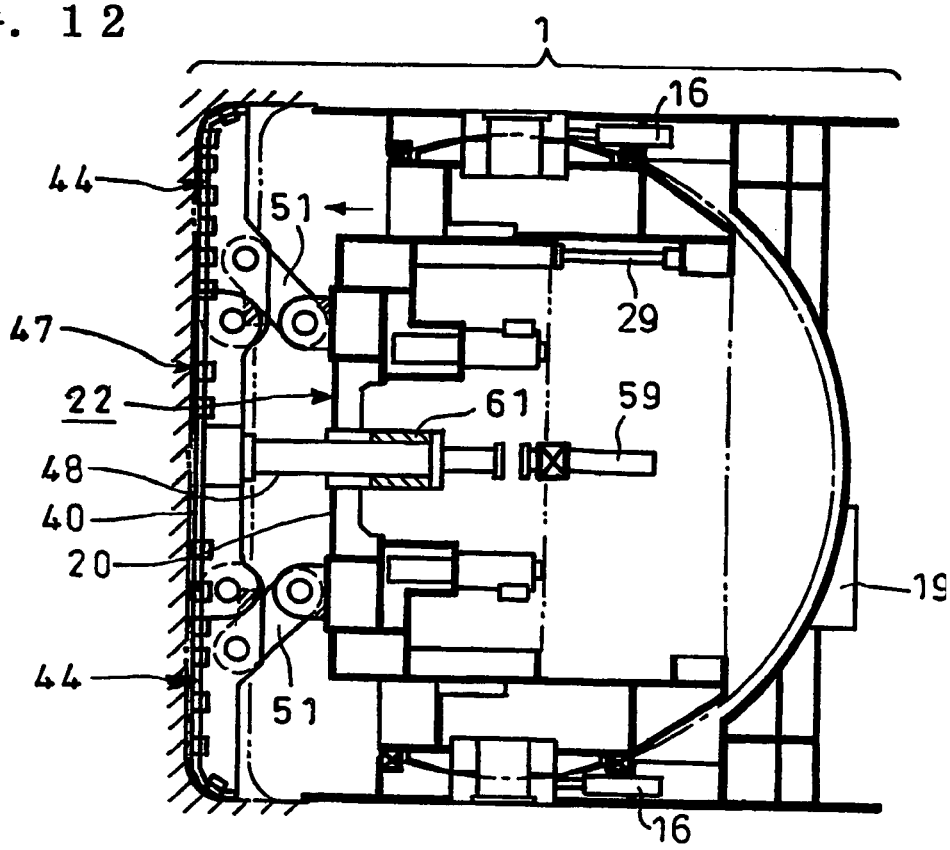
FIG. 12 is a side view in section of the cutter device shown in FIG. 8 in a precedent tunneling operation.

In the state shown in FIG. 8 with tunneling being halted, the cutter device 47 is rotatively driven and the sliding jacks 29 are expanded to advance the excavating drive 22 and cutter device 47 from the position A shown by the solid lines to a position B shown by two-dot-chain lines within which the turning trajectory R can be embraced, thereby effecting a precedent tunneling operation as shown in FIG. 12. Rotation of the cutter device 47 is then stopped.

Figure 13:
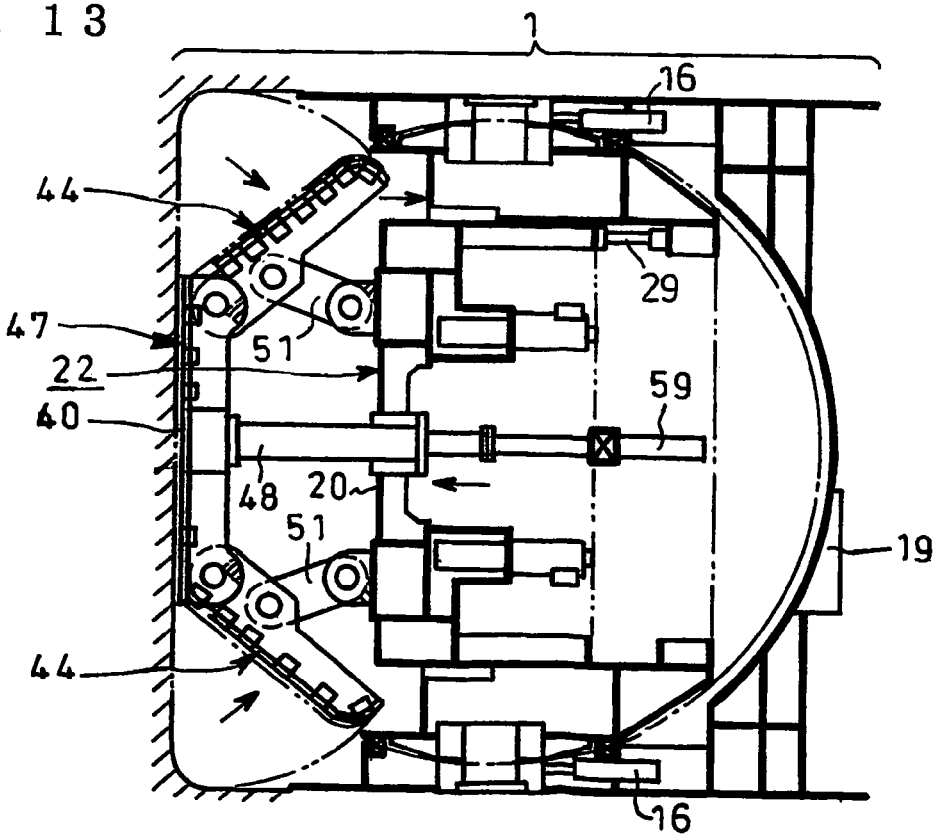
FIG. 13 is a side view in section of the cutter device shown in FIG. 12 in a state of being contracted.

Next, the spacer 61 shown in FIG. 12 is demounted to release the connection between the cutter device 47 and the excavating drive 22; the thrust jack 59 is expanded in phase with contraction of the sliding jacks 29, thereby advancing the cutter device 47 via the center shaft 48 while the excavating drive 22 is retracted. As shown in FIG. 13, the relative movement of the excavating drive 22 and the cutter device 47 away from each other causes the expansion cutters 44 to be pivoted backward owing to the link beams 51 which connect the expansion cutters 44 to the rotor 20 of the excavating drive 22, whereby the assembly of the expansion cutters 44 is reduced in size or height or contracted. Upon such reduction in height of the assembly of the expansion cutters 44, the side protrusion 54 of each of the expansion cutters 44 is overlapped behind the adjacent expansion cutter 44 as shown in FIG. 10 so that each of the expansion cutters 44 can be pivoted backward with no hindrance for reduction in size of the assembly thereof.

Figure 14:
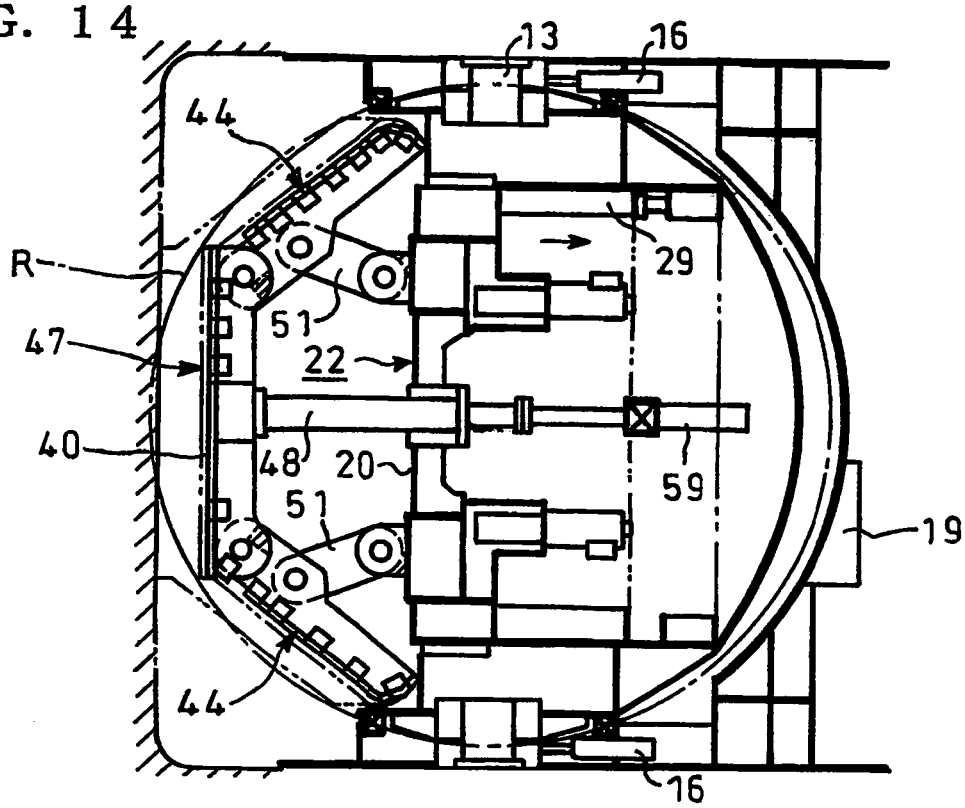
FIG. 14 is a side view in section of the cutter device shown in FIG. 13 in a state of being accommodated in the turnable body.

Then, the sliding jacks 29 are contracted to retract the excavating drive 22 and cutter device 47, with a result that the cutter device 47 is contracted to be accommodated in the turning trajectory R of the turnable body 9 as shown in FIG. 14.

Figure 15:
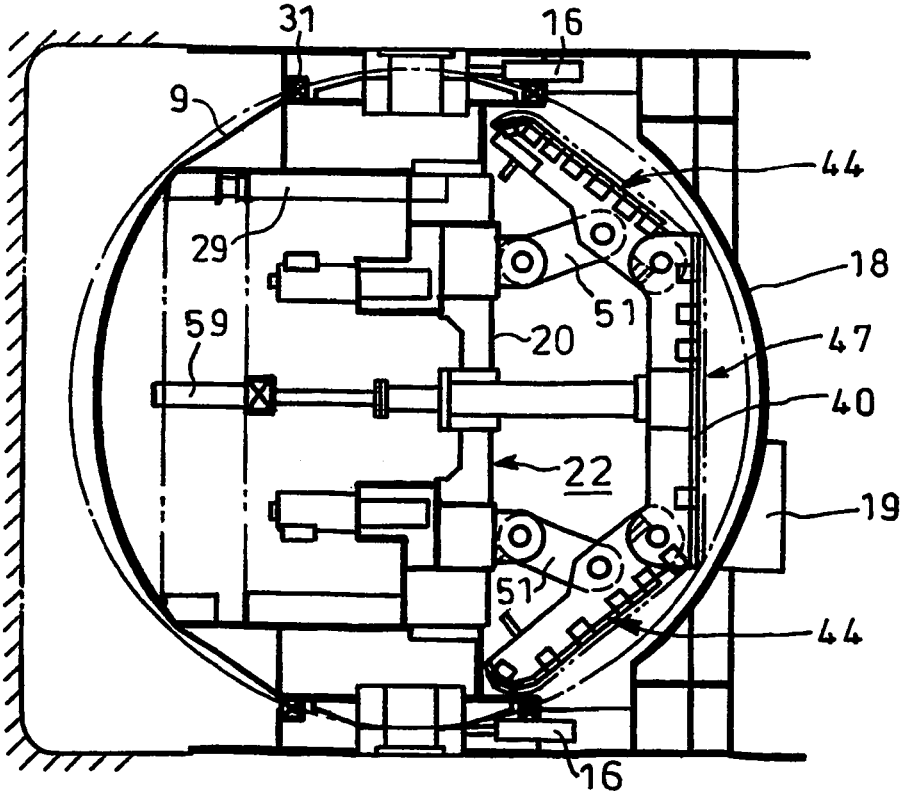
FIG. 15 is a side view in section of the turnable body shown in FIG. 14 in a state of being turned to direct the cutter device backward.

The jacks 16 shown in FIGS. 3 and 14 are actuated to turn the turnable body 9 around the shafts 13 by 180° to direct the cutter device 47 backward as shown in FIG. 15.

During such turning of the turnable body 9, contact between the turnable body 9 and the seal 31 is once released, resulting in intrusion of ground water into backward of the turnable body 9; however, completion of the turning by 180° will bring about re-contact and re-sealing between the turnable body 9 and the seal 31.

Therefore, the ground water intruding between the turnable body 9 and the bulkhead 18 is discharged through the work port 19 to dry the rear of the cutter device 47; then an operator enters forward of the bulkhead 18 through the work port 19 and replaces the damaged bits 35 and 35' in a dry environment. In this chance, for example, repair of the cutters 40 and 44 may be effected.

After the replacement of the damaged bits 35 and 35' on the cutter device 47, the turnable body 9 is turned about in a manner reverse to the above with reference to FIGS. 12 through 15 to re-direct the cutter device 47 forward; then the assembly of the expansion cutters 44 is expanded in the state shown in FIG. 8 again for tunneling.

As mentioned above, the cutter device 47 is composed of the center cutter 40 and the expansion cutters 44 fitted to the outer periphery of the center cutter 40 such that they can be pivoted backward/forward; and the relative movement of the excavating drive 22 and the cutter device 47 toward and away from each other causes the assembly of the expansion cutters 44 to be contracted and expanded through the link beams 51 with a result that the assembly of the expansion cutters 44 can be contracted and expanded with no drive in the cutter chamber 24*a*, which causes no problem of such drive being damaged and which contributes to reliable expansion and contraction of the assembly of the expansion cutters 44.

The peripheral notches 53 between the expansion cutters 44 prevent the cutters 44 from being mutually interfered upon reduction in size or height of the assembly of the cutters 44. Arranged at each of the notches 53 is the side protrusion 54 which provides the narrow take-in slot 55 between the adjacent expansion cutters 44 when the assembly of the expansion cutters 44 is expanded, which makes tunneling to be effected with take-in of soils, pebbles and/or masses of rocks being controlled in size through the take-in slots 55. Thus, the invention can be applied to any grounds which are to be tunneled using a face plate type cutter device.

FIGS. 16 through 22 show a third embodiment of a shield tunneling machine according to the invention in which used in lieu of the stopper means in the form of the connectors 58 in the embodiment of FIGS. 8 through 11, is stopper means in the form of a peripheral ring 62 shaped to extend along the front end of the skin plate 7. Alternatively, such stopper means in the form of the peripheral ring 62 may be provided in addition to the stopper means in the form of the connectors 58 as shown in the embodiment of FIGS. 8 through 11.

Figure 17:
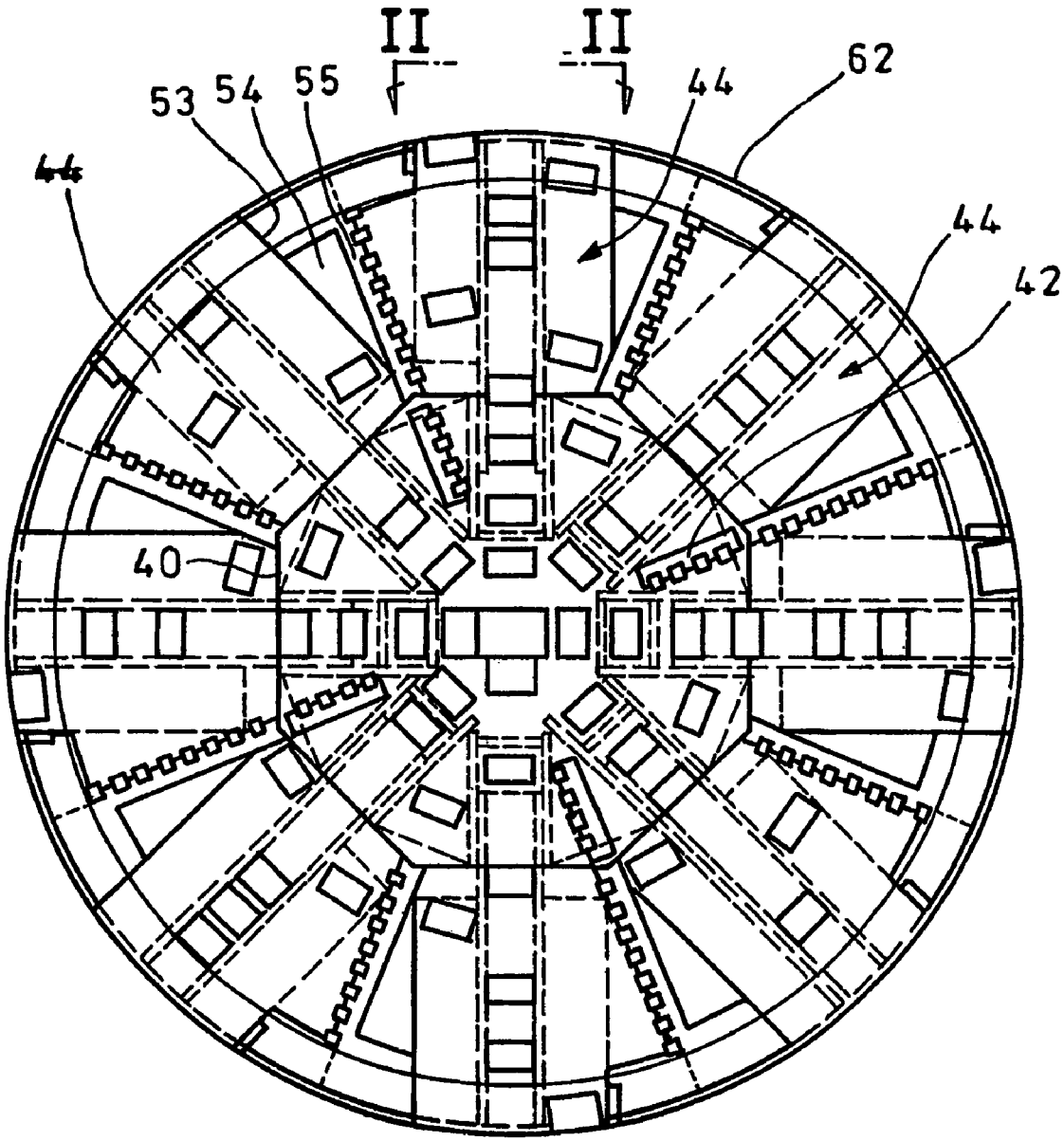
FIG. 17 is a front view of a cutter device shown in FIG. 16.
Figure 18:
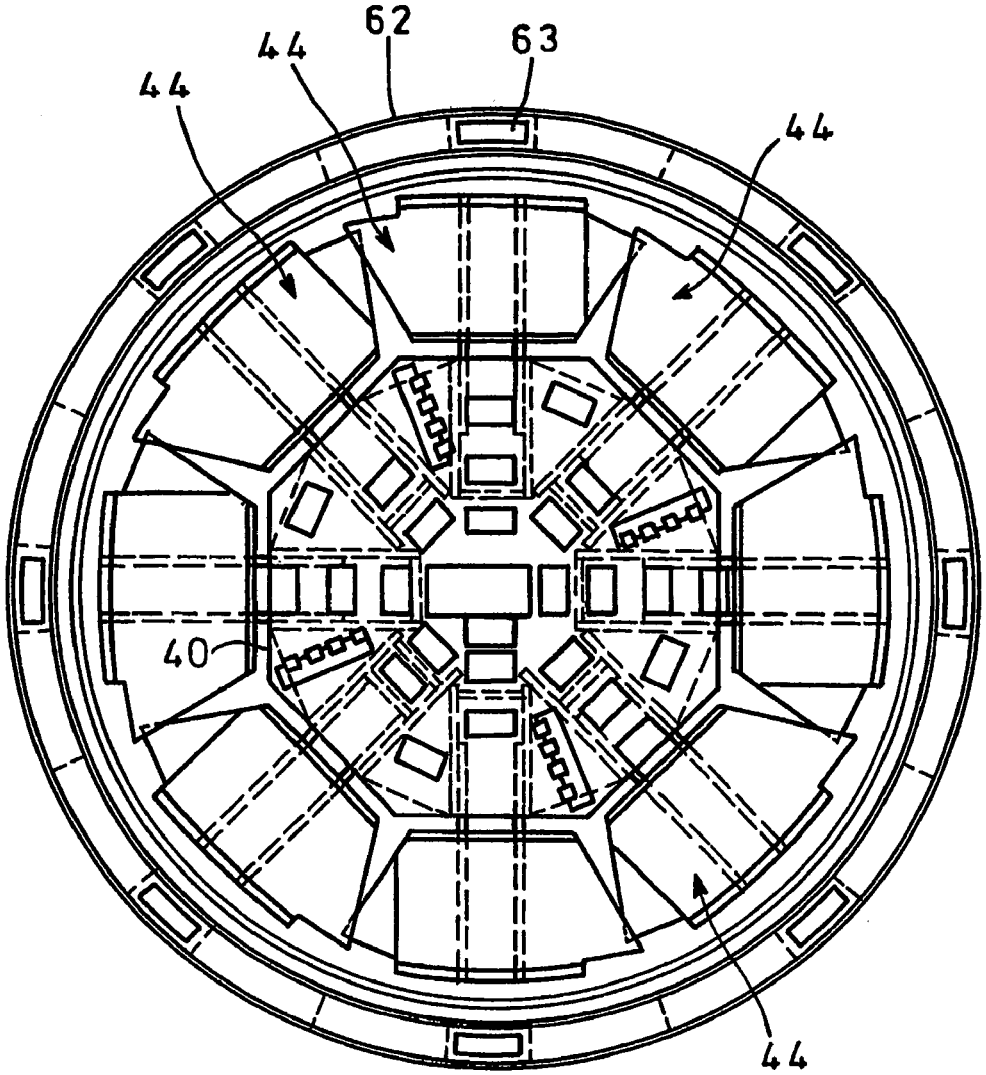
FIG. 18 is a front view of the cutter device shown in FIG. 16 in a state of being contracted.
Figure 19:
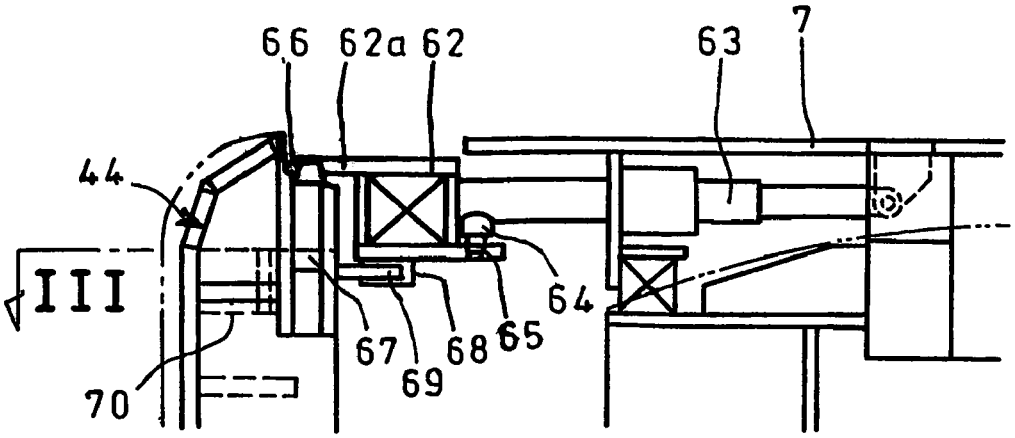
FIG. 19 is a detailed view of a peripheral ring shown in FIG. 16.

The peripheral ring 62 is annular, and extends along the front end of the skin plate 7 as shown in FIGS. 17 through 19. There is provided in the front end of the skin plate 7 horizontal thrust jacks 63 each extending in the direction of tunneling. Each of the thrust jacks 63 has a tip end with a retaining jack 64 attached thereto and extending radially and inwardly of the shield body 1. Each of the retaining jacks 64 may be expanded and contracted to be fitted into and removed out of an opening 65 on the peripheral ring 62, thereby attaching and detaching the peripheral ring 62 to and from the skin plate 7.

Figure 20:
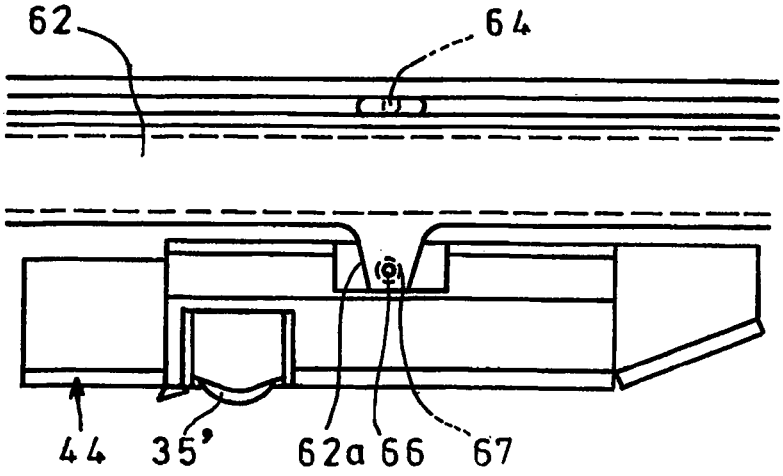
FIG. 20 is a view looking in the direction of arrows II in FIG. 17.

On the other hand, as shown in FIGS. 19 and 20, each of the expansion cutters 44 has, at its portion adjacent to its outer periphery, a radial retaining jack 67 which may be fitted into and removed from a corresponding opening 66 on a front extension 62*a* extending from the peripheral ring 62. The retaining jacks 67 serve to attach and remove the peripheral ring 62 to and from the expansion cutters 44.

Figure 21:
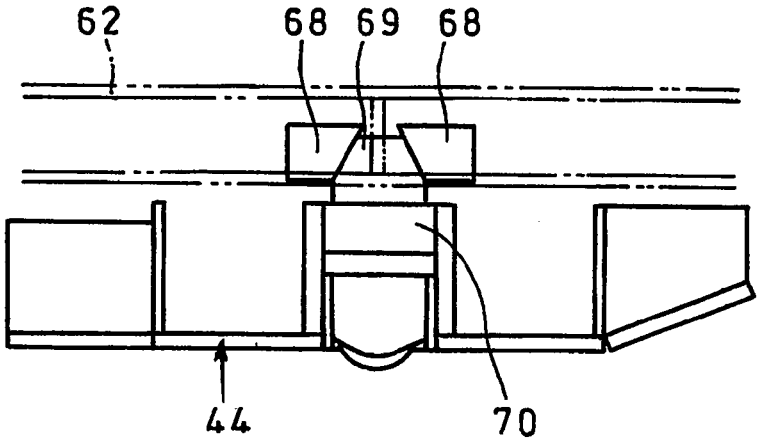
FIG. 21 is a view looking in the direction of arrow III in FIG. 19.

Each of the expansion cutters 44 also has, at its portion adjacent to its outer periphery, a torque transmission jack 70 as shown in FIGS. 19 and 21 which can be expanded backward to engage a wedge block 69 with a torque transmission block 68 on an inner surface of the peripheral ring 62, thereby transmitting torque of the expansion cutter 44 to the peripheral ring 62.

Figure 22:
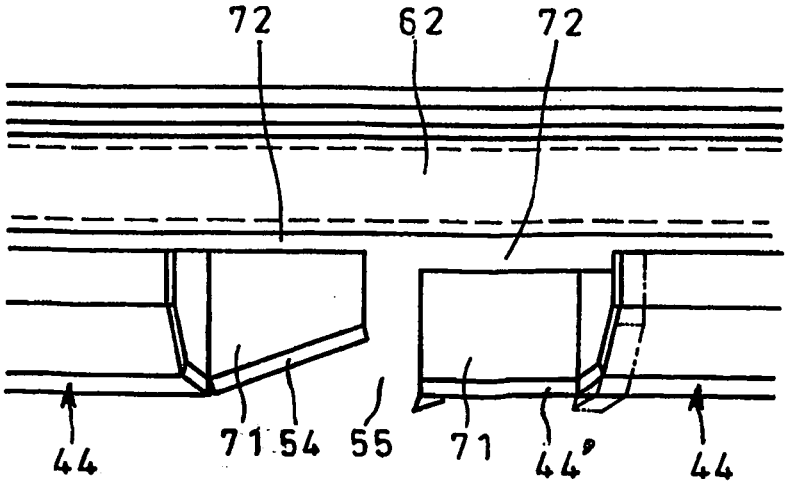
FIG. 22 is a view looking in the same direction as that in FIG. 20 and showing a side protrusion with a rear face plate.

As shown in FIG. 22, the side protrusion 54 on each of the expansion cutters 44 is beveled so as to be overlapped behind a face plate 44', which may be notched as shown, of the adjacent expansion cutter 44 for prevention of interference with each other. Each of the side protrusions 54 and face plates 44' is braced at its back by a rear face plate 71 which provides a small take-in slot 72 between the expansion cutter 44 and the peripheral ring 62.

Next, the mode of operation of the third embodiment will be described.

Figure 16:
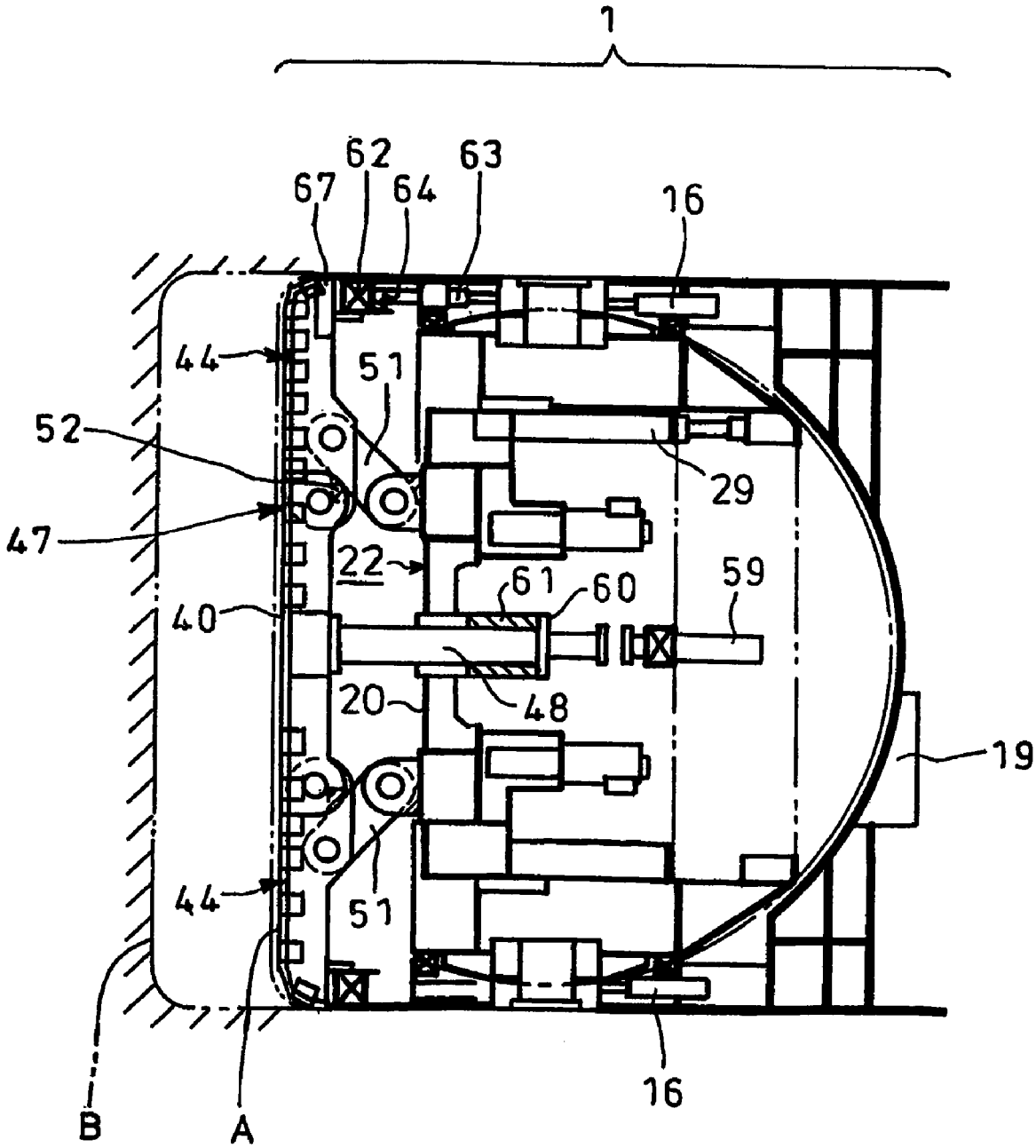
FIG. 16 is a side view in section of a shield tunneling machine according to a third embodiment of the invention.

In FIG. 16, the axis of the shield body 1 is aligned with that of the excavating drive 22; the excavating drive 22 is constrained in position adjacent to the cutter device 47 with the spacer 61 being fitted over the center shaft 48; and the expansion cutters 44 are pivoted forward by the link beams 51 for expansion of the assembly thereof.

In order to effect tunneling, in FIGS. 16, 19 and 20, the retaining jacks 64 are contracted and then the thrust jacks 63 are contracted to thereby detach the peripheral ring 62 from the skin plate 7 while the retaining jacks 67 on the expansion cutters 44 are expanded to be fitted into the openings 66 on the peripheral ring 62 to thereby fix the latter to the expansion cutters 44. Then, the torque transmission jacks 70 shown in FIGS. 19 and 21 are expanded to engage the wedge blocks 69 to the torque transmission blocks 68 with the result that torque of the expansion cutters 44 is transmitted to the peripheral ring 62.

As mentioned above, the expansion cutters 44 are integrally interconnected by the peripheral ring 62 into a face plate type cutter combination. Therefore, the rotary drive motor 25 is driven to rotate the cutter device 47 through the link beams 51 so that the expansion cutters 44 are rotated in one and the same trajectory, resulting in stable tunneling.

With the narrow take-in slots 55 defined by the side protrusions 54 and the expansion cutters 44 and the narrow take-in slots 72 defined by the rear face plates 71 and the peripheral ring 62 as shown in FIG. 22, tunneling can be effected with size of soils, pebbles and/or masses of rocks to be taken in being controlled.

Replacement of the damaged bits 35 and 35' on the cutter device 47 will be described, starting from the state of being tunneled.

First, tunneling is halted. Then, required are reduction in size or height of the cutter device 47 into a size accommodable in the turning trajectory R and subsequent turning of the turnable body 9 to direct the cutter device 47 backward.

These are carried out as follows.

FIG. 16 shows a state of the thrust jacks 63 being expanded to be connected to the peripheral ring 62; upon tunneling, with the peripheral ring 62 being fixed to the cutter device 47 and being disconnected from the thrust jacks 63, shield jacks (not shown) are expanded to advance the shield body 1 for tunneling.

The above-mentioned tunneling is halted and, in order to effect a precedent tunneling operation, the cutter device 47 is rotatively driven and the sliding jacks 29 are expanded to advance the excavating drive 22 and the cutter device 47 from the position A shown by solid lines to a position B shown by two-dot-chain lines within which the turning trajectory R is encompassed. The rotation of the cutter device 47 is then stopped.

Then, the sliding jacks 29 are contracted to retract back the cutter device 47 and the excavating drive 22 to the position A shown in solid line in FIG. 16.

The thrust jacks 63 shown in FIG. 19 are expanded and then the retaining jacks 64 are expanded to be fitted into the openings 65 on the peripheral ring 62 with a result that the peripheral ring 62 is connected to the skin plate 7. This is shown in FIG. 16.

Then, the retaining jacks 67 on the expansion cutter 44 are contracted to be moved away from the openings 66, thereby releasing the interlock between the peripheral ring 62 and the expansion cutters 44. Further, the torque transmission jacks 70 shown in FIGS. 19 and 21 are contracted to move the wedge blocks 69 away from the torque transmission blocks 68, whereby the peripheral ring 62 is disconnected from the expansion cutters 44 and thus from the cutter device 47 and is supported by the skin plate 7 via the thrust jacks 63.

Figure 23:
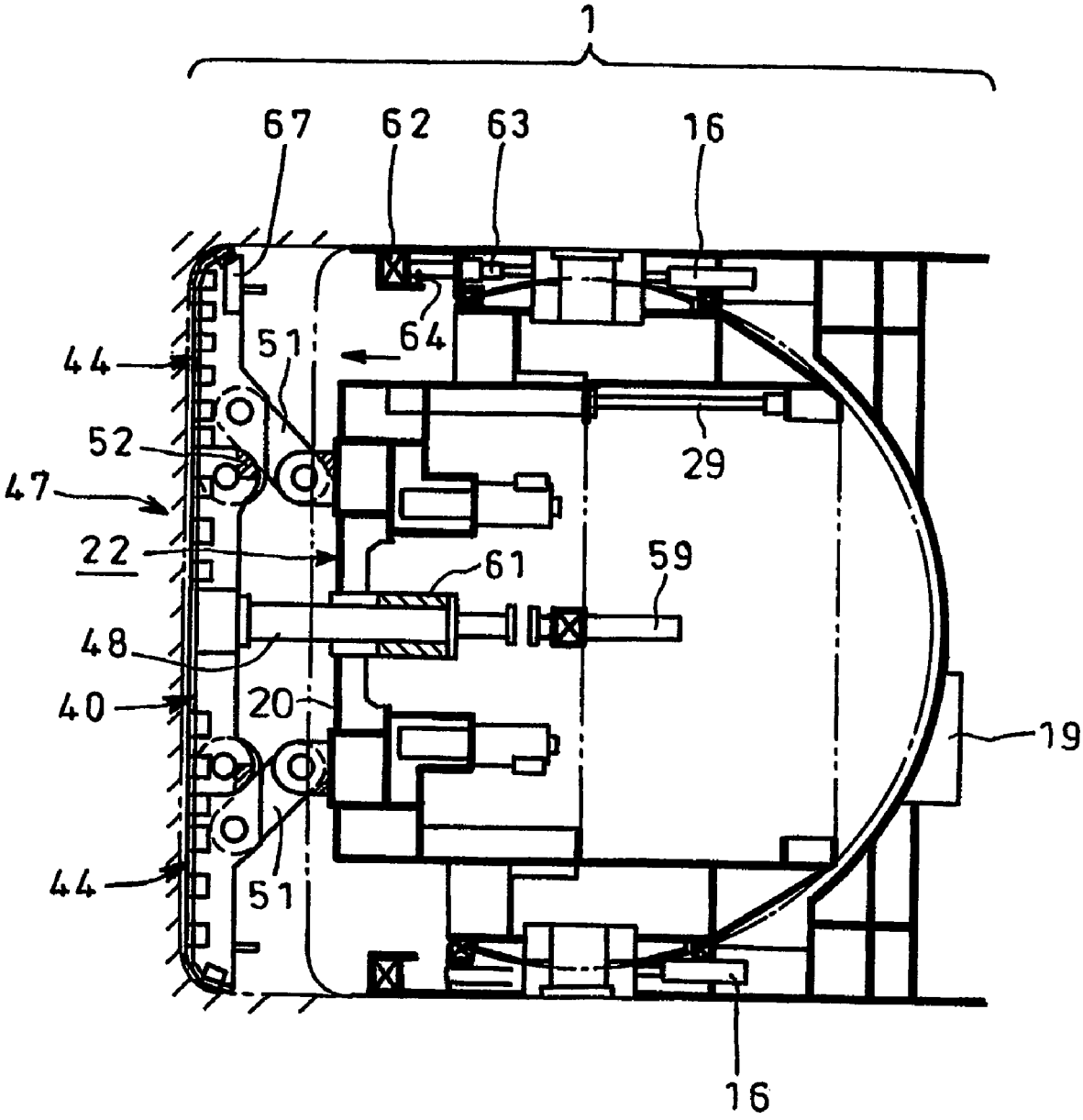
FIG. 23 is a side view in section of the cutter device shown in FIG. 16 in a precedent tunneling operation.

Then, the sliding jacks 29 are expanded to advance the cutter device 47 into a forefront position as shown in FIG. 23 attained in the precedent tunneling operation, with the peripheral ring 62 being left unmoved.

Figure 24:
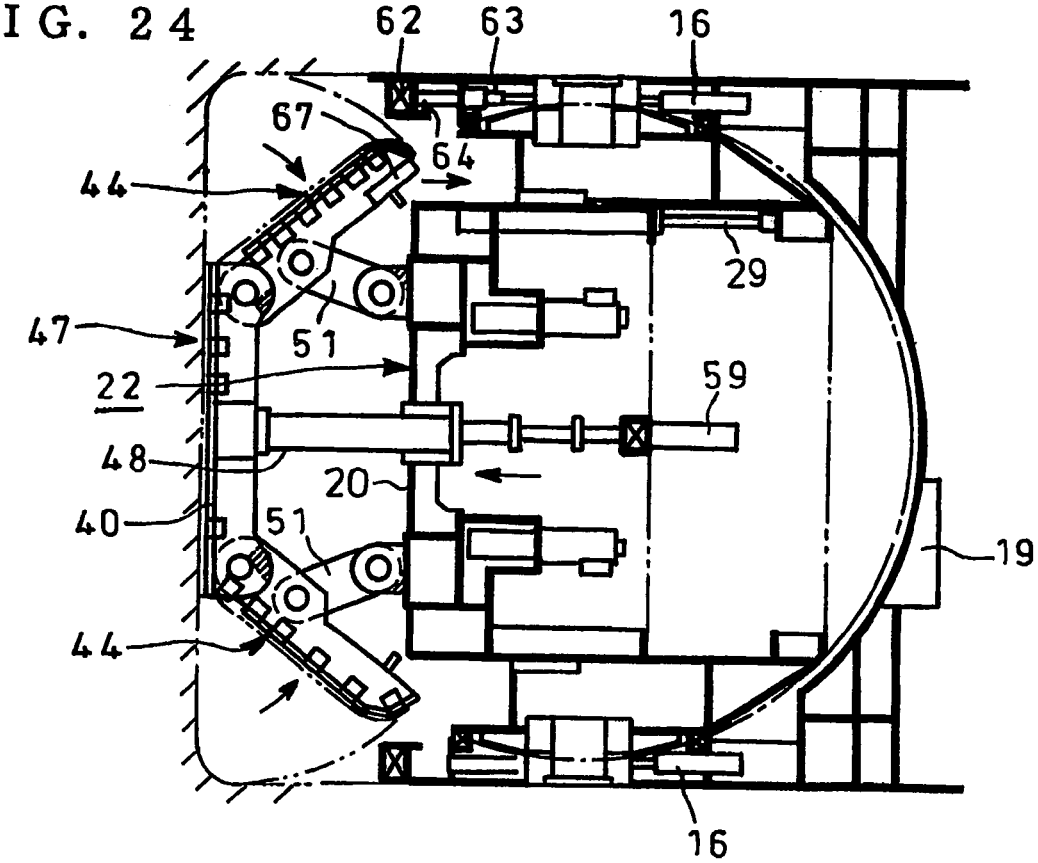
FIG. 24 is a side view in section of the cutter device shown in FIG. 23 in a state of being contracted.

Next, the spacer 61 shown in FIG. 23 is dismounted to release the interlock between the cutter device 47 and the excavating drive 22, and the sliding jacks 29 are contracted in phase with expansion of the thrust jack 59, thereby retracting the excavating drive 22 with the cutter device 47 being left at the forefront position. Such relative movement of the excavating drive 22 and the cutter device 47 away from each other as shown in FIG. 24 causes the expansion cutters 44 to be pivoted backward by the action of the link beam 51, whereby the assembly of the expansion cutters 44 is contracted in size or height. With the peripheral ring 62 being left in an inoperative position, the assembly of the expansion cutters 44 is contracted in size or height with no interference with the peripheral ring 62; each of the cutters 44 can be pivoted backward with no hindrance since each of the side protrusions 54 shown in FIG. 22 is beveled so as to be overlapped behind the face plate 44' of the adjacent expansion cutter 44.

Figure 25:
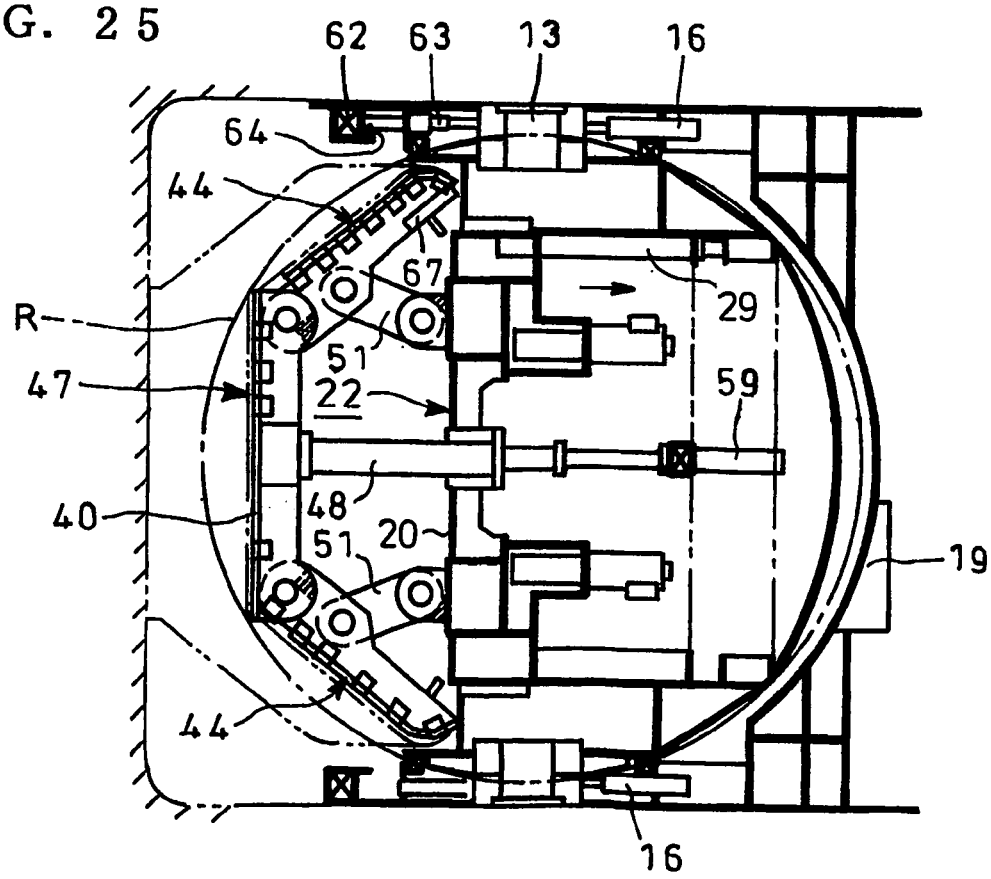
FIG. 25 is a side view in section of the cutter device shown in FIG. 24 in a state of being accommodated in the turnable body.

Then, the sliding jacks 29 are contracted to retract the excavating drive 22 and the cutter device 47 so that the latter is accommodated in the turning trajectory R of the turnable body 9 as shown in FIG. 25.

Figure 26:
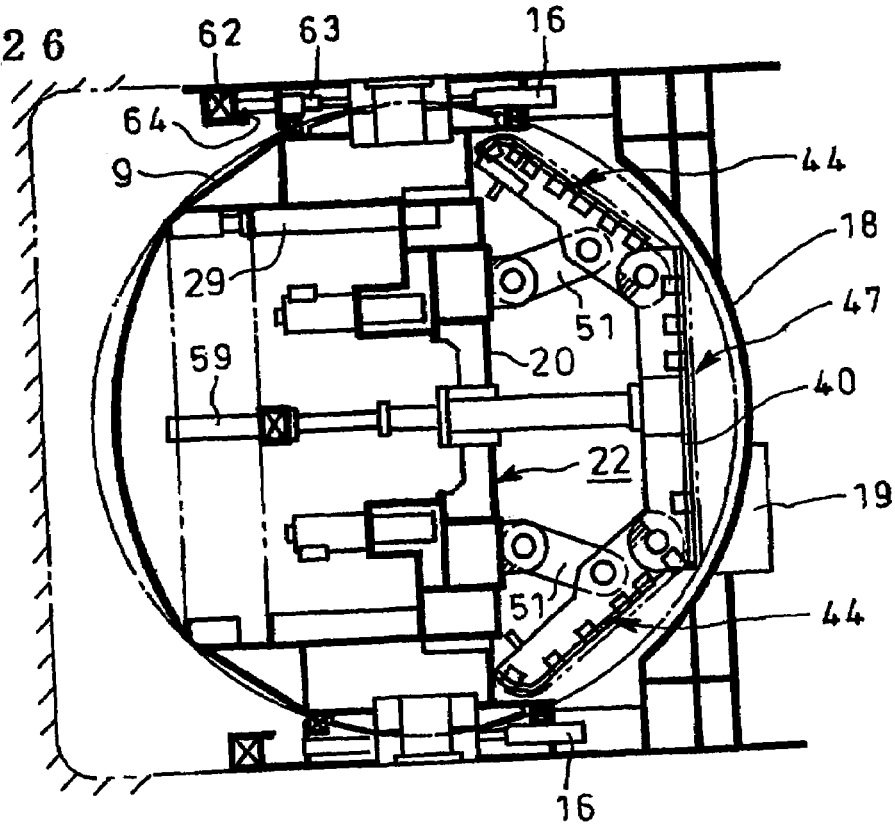
FIG. 26 is a side view in section of the turnable body shown in FIG. 25 in a state of being turned to direct the cutter device backward.

Further, the jacks 16 shown above and blow in FIGS. 3 and 25 are actuated to turn the turnable body 9 around the shafts 13 by 180° to direct the cutter device 47 backward as shown in FIG. 26 with a result that the damaged bits 35 and 35' on the cutter device 47 can be replaced in a dry environment.

After the replacement of the damaged bits 35 and 35' on the cutter device 47, the turnable body 9 is turned in a manner reverse to that shown in FIGS. 23 through 26 to re-direct the cutter device 47 forward; and the assembly of the expansion cutters 44 is expanded in size or height into the state of FIG. 16 again; and then, tunneling is effected with the peripheral ring 62 being fixed to the cutter device 47 and disconnected from the thrust jacks 63. In the above, movement of the peripheral ring 62 forward is made by the small-sized thrust jacks 63 so that no excessive force acts on the peripheral ring 62.

Figure 27:
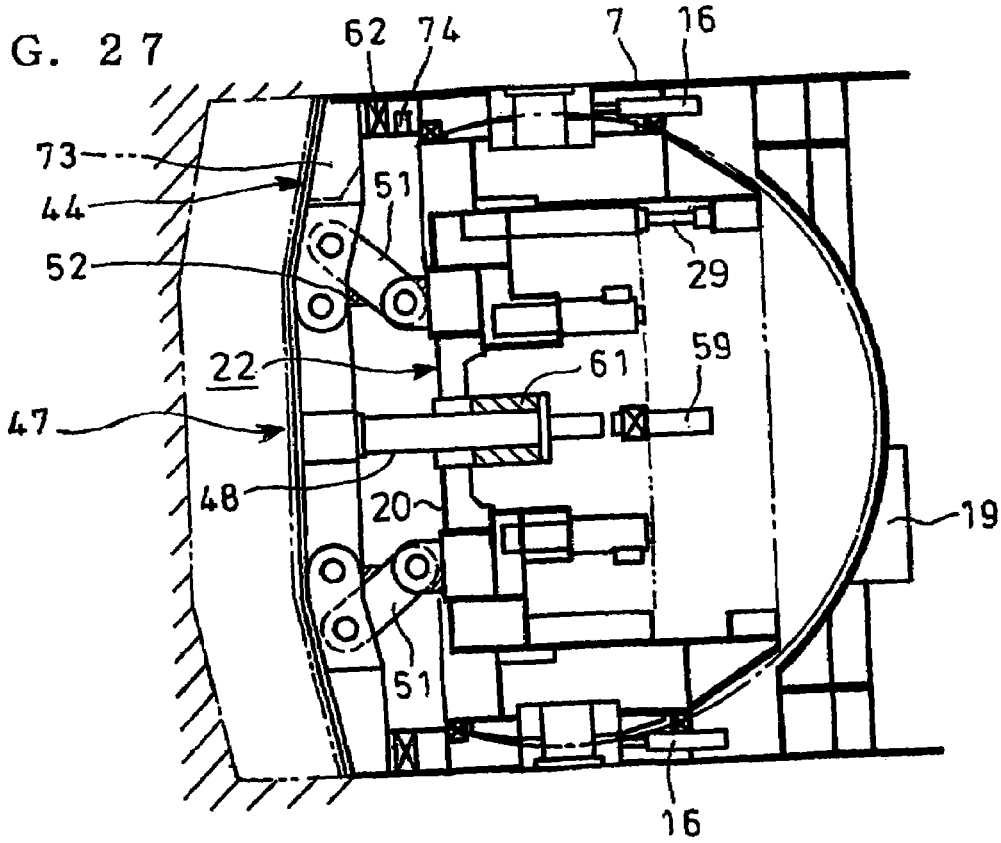
FIG. 27 is a side view in section of a modification of the embodiment shown in FIG. 16.
Figure 28:
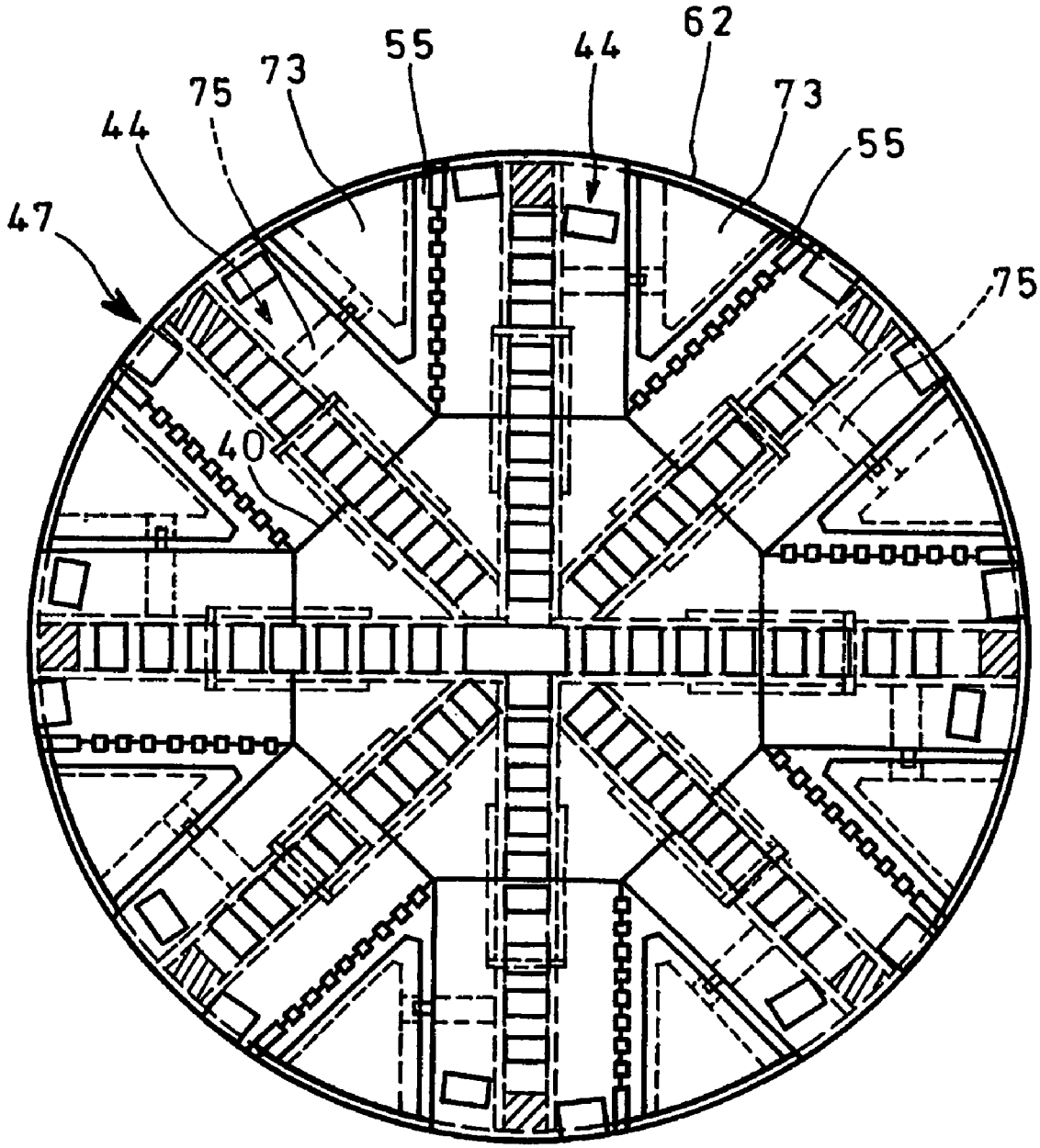
FIG. 28 is a front view of a cutter device shown in FIG. 27.

FIGS. 27 and 28 show a modification with a peripheral ring 62 similar to that of the embodiment of FIGS. 16 through 22. The modification shown in FIGS. 27 and 28 is different from the embodiment shown in FIGS. 16 through 22 in that a cutter device 47 has expansion cutters 44 slightly inclined backward relative to a front surface of a center cutter 40 when an assembly of the cutters 44 is expanded maximum. Each of the expansion cutters 44 shown in FIGS. 27 and 28 is not fan-shaped but rectangular, having no side protrusion 54. Instead, substantially triangular inner protrusions 73 are attached to the inner surface of the peripheral ring 62 and extend in V-shaped space between the expansion cutters 44 when the assembly of the cutters 44 is expanded. The inner protrusions 73 define together with the expansion cutters 44 narrow take-in slots 55. The peripheral ring 62 is detachably fixed to the skin plate 7 by fixtures 74, having no thrust jacks 63 as mentioned above. Each of the rectangular expansion cutters 44 has a retaining jack 75 for connection with the corresponding inner protrusion 73.

In order to effect tunneling in the modification shown in FIGS. 27 and 28, the cutter device 47 and the excavating drive 22 are relatively moved toward each other to expand the assembly of the expansion cutters 44 through the link beams 51; then, the peripheral ring 62 is fixed through the retaining jacks 75 to the cutter device 47 and is detached from the skin plate 7 by releasing the fixtures 74. This ensures stable tunneling with the assembly of the expansion cutters 44 being rotated in a state of being kept in the face plate shape by the peripheral ring 62, whereby stable tunneling can be effected.

In order to replace damaged bits 35 and 35' on the cutter device 37 from the above-mentioned state of being tunneled, first, tunneling is halted. Then, the peripheral ring 62 is fixed to the skin plate 7 by the fixtures 74 and the retaining jacks 75 are contracted to release the interlock between the expansion cutters 44 and the peripheral ring 62. Then, in a manner similar to that shown in FIGS. 23 through 26, the damaged bits 35 and 35' on the cutter device 47 can be replaced.

FIGS. 29 through 32 show a fourth embodiment of a shield tunneling machine according to the invention which is similar to the embodiment shown in FIGS. 16 through 22; the former is mainly different from the latter in that it comprises an inner cylinder 76 which is in a skin plate 7 and which has thrust jacks 63 capable of moving a peripheral ring 62 backward/forward.

The fourth embodiment makes it possible to direct backward a cutter device 47 by a turnable body 9 for replacement of damaged bits 35 and 35' even in a case where a precedent tunneling operation as mentioned above cannot be effected due to damage of the bits 35 and 35' on the cutter device 47. Failure of the precedent tunneling operation in any of the above-mentioned embodiments would necessitate retraction the skin plate 7 itself together with a shield frame 3 so as to obtain a space for turning of the turnable body 9 to direct the cutter device 47 backward; however, retraction of the skin plate 7 may cause a problem of a tail seal being damaged which is provided on a rear end of the skin plate 7 for sealing between the latter and the segments S. To avert this problem, the fourth embodiment enables the turnable body 9 to be turned without a precedent tunneling operation nor retraction of the skin plate 7.

Figure 29:
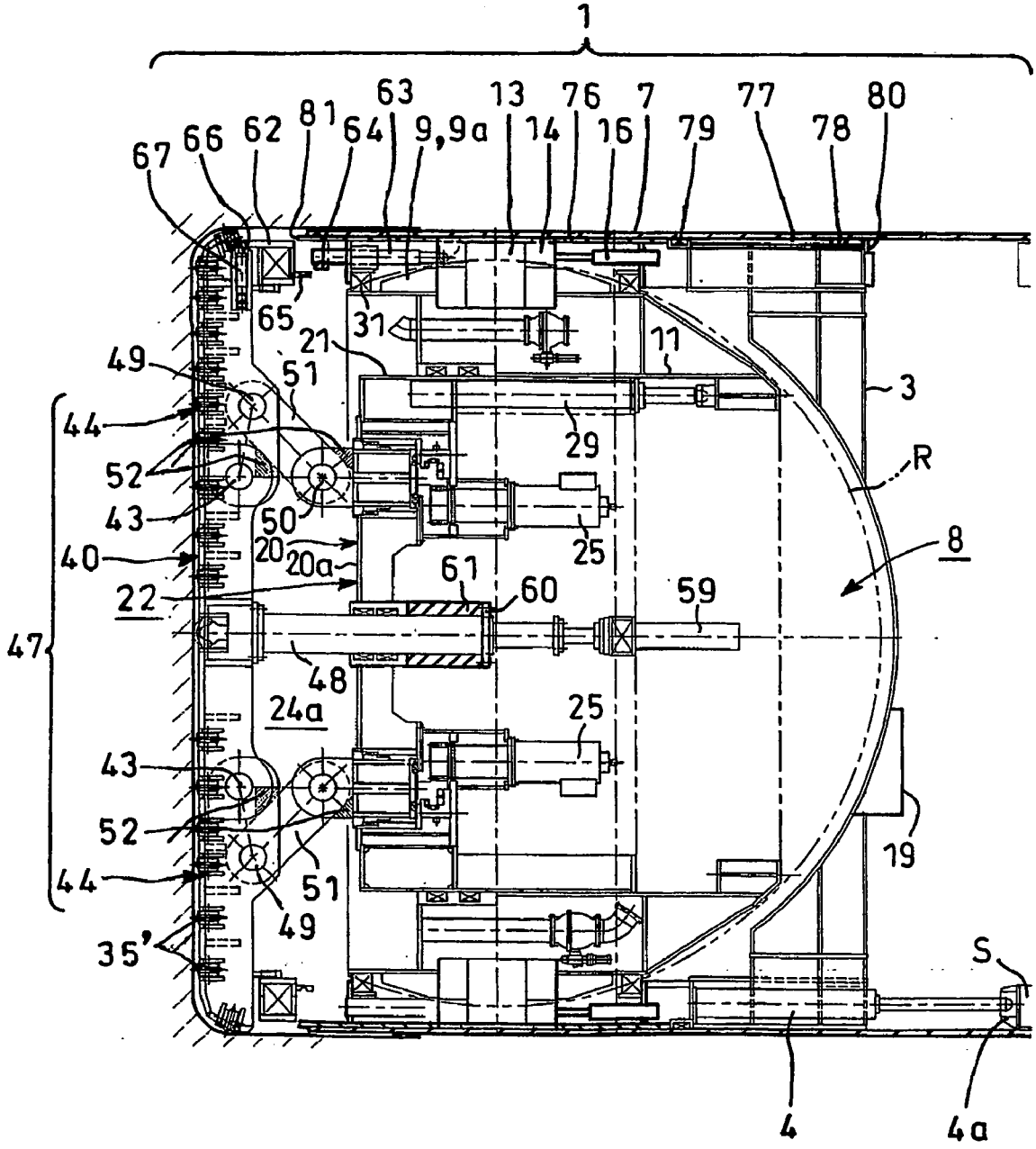
FIG. 29 is a side view in section of a shield tunneling machine according to a fourth embodiment of the invention.

More specifically, as shown in FIG. 29, the inner cylinder 76 is arranged in the skin plate 7 such that it can be moved backward/forward relative to the skin plate 7. The shield frame 3 is arranged in and fixed to a rear end of the inner cylinder 76. Arranged ahead of the shield frame 3 and in the inner cylinder 76 is the turnable body 9 which may be turned about an axis perpendicular to the axis of the shield body 1. The shield frame 3 has shield jacks 4 each of which can be expanded by reaction force from the corresponding segment S to advance the inner cylinder 76.

Figure 30:
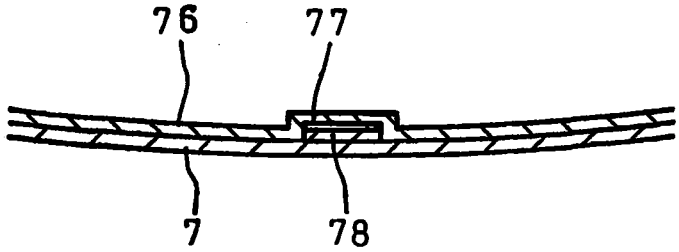
FIG. 30 is a partial front view in section showing a relationship between a skin plate and an inner cylinder of FIG. 29.

The inner cylinder 76 has, as shown in FIGS. 29 and 30, an outer surface formed with an axially extending concavity 77 while the skin plate 7 has an inner surface formed with a convexity 78 for engagement with the concavity 77. The concavity 77 and convexity 78 cause the skin plate 7 and inner cylinder 76 to be axially movable and circumferentially immovable. Reference numeral 79 denotes a seal between the skin plate 7 and the inner cylinder 76.

The shield frame 3 has a locking part 80 fixed thereto and abutting on a rear end of the convexity 78; when the inner cylinder 76 is advanced by expanding the shield jacks 4, the locking part 80 abutting on the convexity 78 causes the skin plate 7 to be advanced in unison. The inner cylinder 76 is of a length such that a front end 81 of the inner cylinder 76 is protruded ahead of the front end of the skin plate 7 as shown in FIG. 29 when the inner cylinder 76 is advanced.

Figure 31:
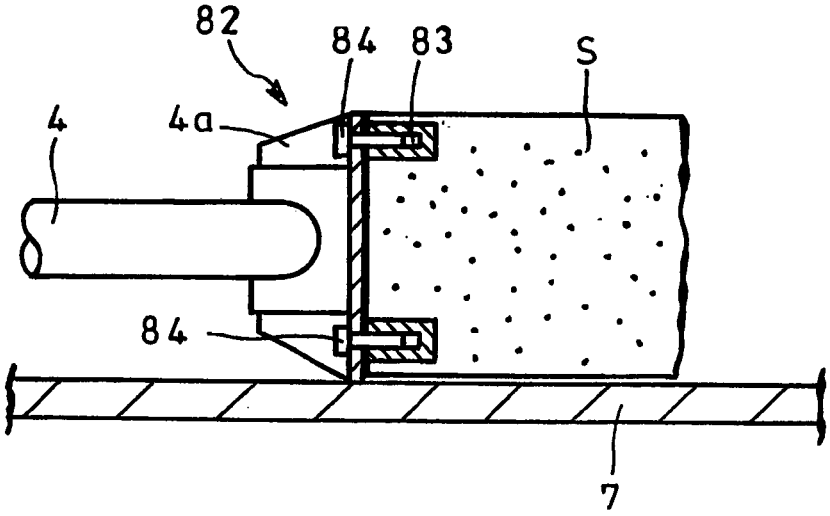
FIG. 31 is a side view in section of an embodiment of a fixture for fixing a jack shoe of FIG. 29 to a segment.
Figure 32:
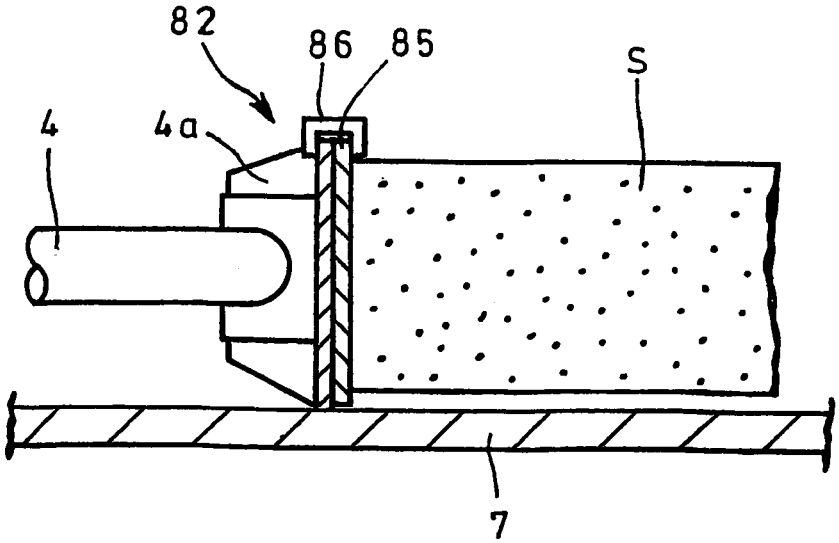
FIG. 32 is a side view in section of a further embodiment of the fixture.

As shown in FIG. 31 or 32, each of the shield jacks 4 has a jack shoe 4*a* which can be fixed to the corresponding segment S by a fixture 82. FIG. 31 shows an embodiment where each of the segments S is made of concrete and has threaded holes 83 to which the jack shoe 4*a* is secured by bolts 84. FIG. 32 shows a further embodiment where each of the segments S is made of steel and has a flange 85; the jack shoe 4*a* is secured to the segment S by a U-shaped locking part 86 fitted over the flange 85 and the jack shoe 4*a*.

As shown in FIG. 31 or 32, with the jack shoe 4*a* of each of the shield jacks 4 being fixed to the corresponding segment S by the fixture 82, contraction of the shield jacks 4 causes the inner cylinder 76 to be retracted relative to the skin plate 7.

Arranged ahead of the inner cylinder 76 is a peripheral ring 62 similar to that shown in the embodiment of FIGS. 16 through 22 which can be connected to and disconnected from the inner cylinder 76 and the expansion cutters 44.

Next, the mode of operation of the fourth embodiment will be explained.

In FIG. 29 and with a state of being tunneled, the axis of the skin plate 7 is aligned with that of the excavating drive 22; the excavating drive 22 and the cutter device 47 are constrained in position adjacent to each other so that the assembly of the expansion cutters 44 is held in expansion with the cutters 44 being pivoted forward by the link beams 51. The spacer 61 is fitted over the center shaft 48 between the flange 60 and the rotor 20 with the center cutters 40 being made immovable relative to the excavating drive 22.

The abutment members 52 on the center cutter 40 and the rotor 20 of the excavating drive 22 prevent the link beams 51 from being flattened to have less slant angles, which prevents the forwardly pivoted expansion cutters 44 from being pivoted backward by reaction force from tunneling.

Connected to outer peripheries of the expansion cutters 44 is a peripheral ring 62. More specifically, retaining jacks 67 on the expansion cutters 44 are expanded to be fitted into openings 66 on the peripheral ring 62; then, torque transmission jacks 70 as shown in FIGS. 19 and 21 are expanded to engage wedge blocks 69 with torque transmission blocks 68 with a result that the expansion cutters 44 are integrally fixed into a face plate shape via the peripheral ring 62. Then, the retaining jacks 64 on the thrust jacks 63 are contracted and to be removed from the peripheral ring 62, the thrust jacks 63 being kept contracted.

Thus, drive of the rotary drive motor 25 causes the cutter device 47 to be rotated via the link beams 51 with a result that excavation can be effected safely with the cutter device 47. Further, the shield jack 4 is expanded to advance the inner cylinder 76 and rotary shield device 8, using reaction force from the segments S; with the locking part 80 abutting on the convexity 78, the skin plate 7 is advanced in unison with the inner cylinder 76 with a result that tunneling is effected with the cutter device 47.

During such tunneling, the narrow take-in slots 55 are provided between the expansion cutters 44 by the side protrusion 54 on each of the cutters 44 as shown in FIG. 17. With these take-in slots 55 and the take-in slots 42 on the center cutter 40, tunneling can be effected with size of soils, pebbles and/or masses of rocks to be taken in through the take-in slots being controlled. Thus, the invention can apply to tunneling of grounds to be tunneled with a face plate type cutter device.

Replacement of the damaged bits 35 and 35' on the cutter device 47 will be described, starting from the state of being tunneled.

First, tunneling is halted. Then, required are reduction in size or height of the cutter device 47 into a size accommodable in the turning trajectory R and subsequent turning of the turnable body 9 to direct the cutter device 47 backward. These are carried out as follows.

Figure 33:
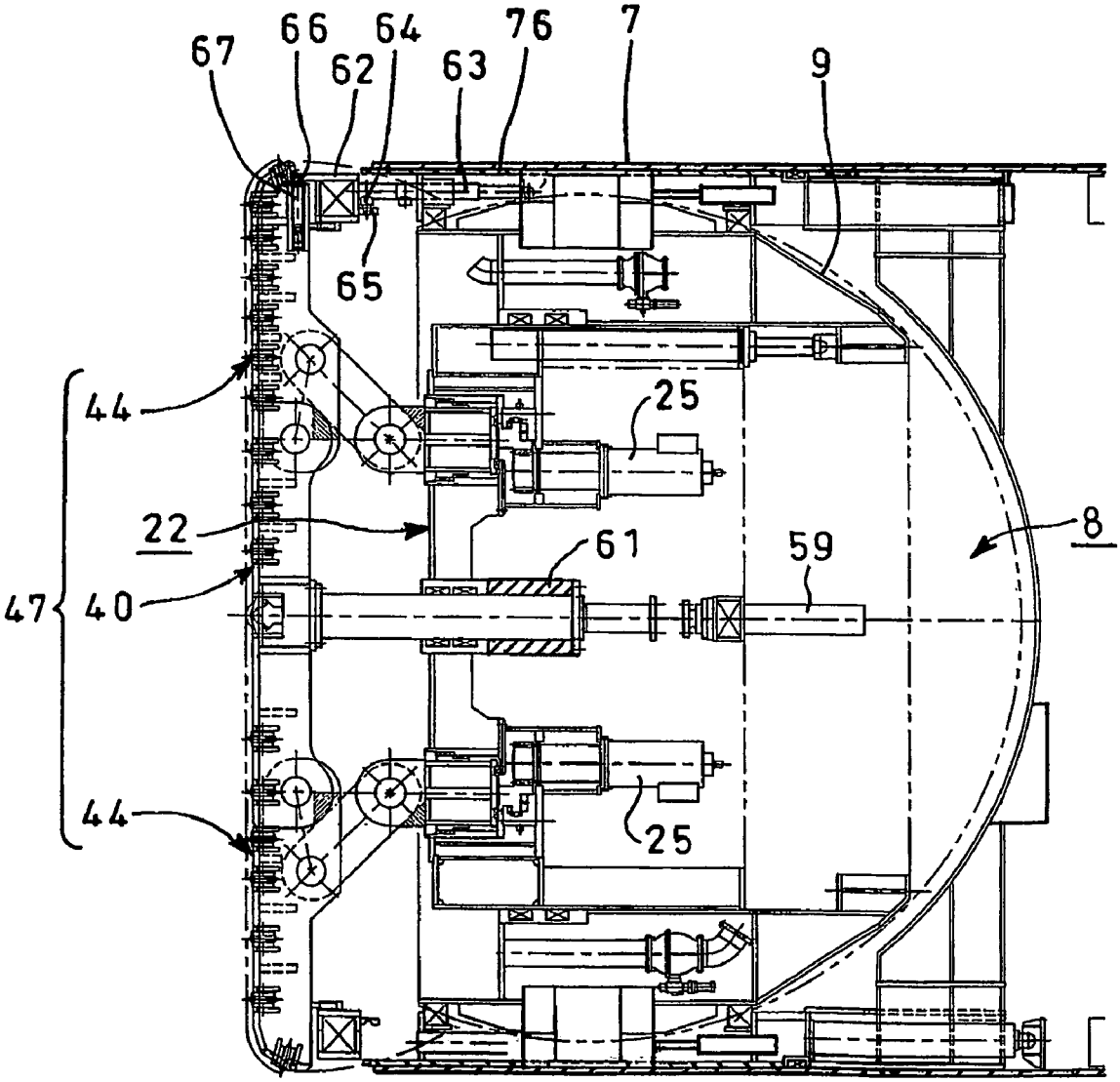
FIG. 33 is a side view in section showing a state of a thrust jack being connected to a peripheral ring of FIG. 29.

In the state of FIG. 29 and with tunneling being halted, the thrust jacks 63 on the inner cylinder 76 are expanded and the retaining jacks 64 are expanded into the openings 65 of the peripheral ring 62 as shown in FIG. 33 with a result that the peripheral ring 62 is connected to the thrust jacks 63. Then, the retaining jacks 67 on the expansion cutters 44 are contracted to be disengaged from the openings 66 on the peripheral ring 62; and then, the thrust jacks 63 are contracted to retract the peripheral ring 62 as shown in FIG. 34.

Figure 34:
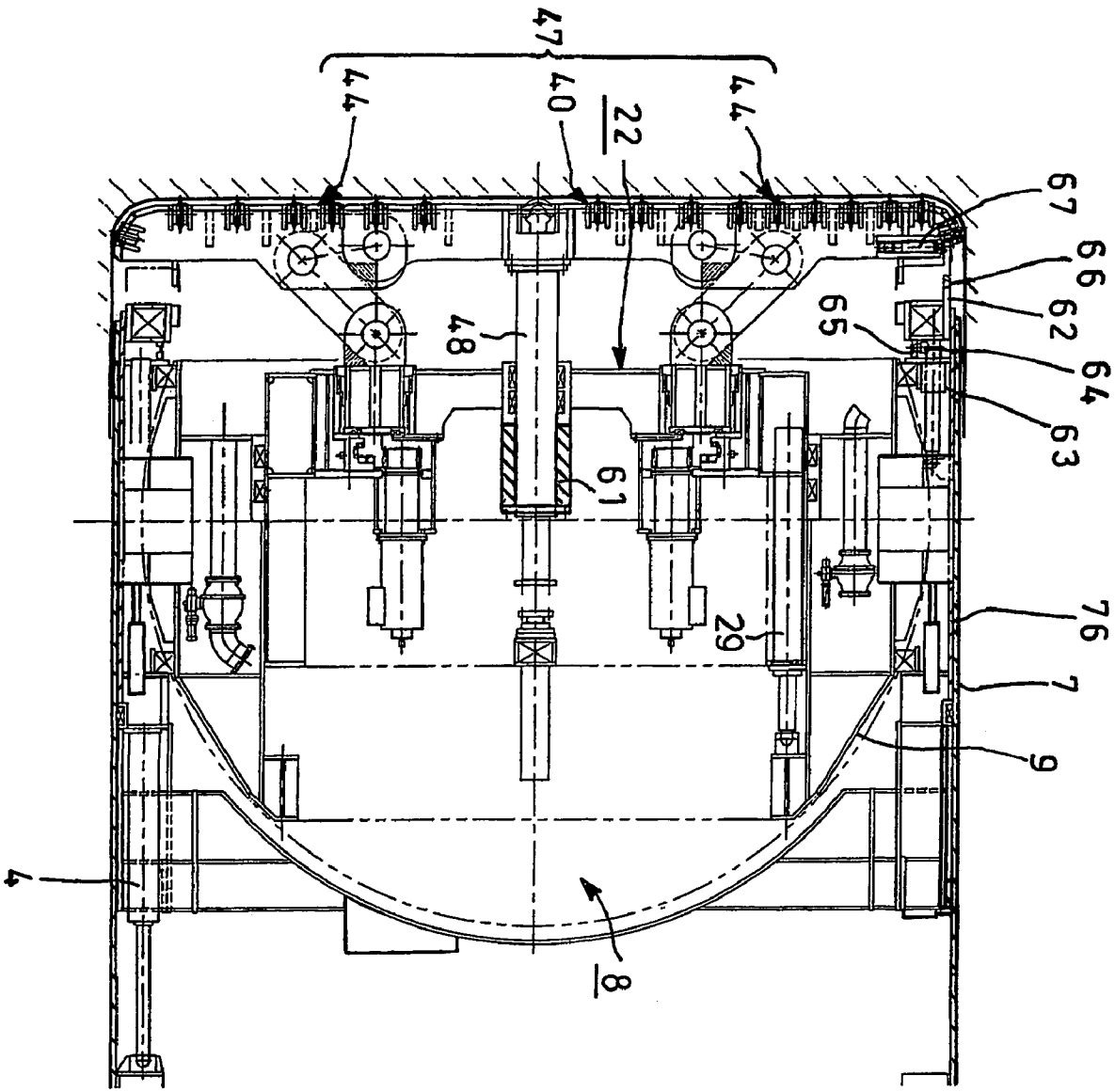
FIG. 34 is a side view in section showing a state of the peripheral ring being detached from the cutter device of FIG. 33, the thrust jack being contracted to retract the peripheral ring.

Then, the spacer 61 shown in FIG. 34 is removed to release the interlock between the center cutter 40 and the excavating drive 22. Further, as shown in FIG. 31 or 32, the jack shoe 4*a* of each of the shield jacks 4 is fixed via the fixture 82 to the corresponding segment S.

Then, in order to leave the cutter device 47 at the forefront position shown in FIG. 34 where tunneling is halted, the shield jacks 4 are contracted in phase with expansion of the sliding jacks 29 with a result that the inner cylinder 76 is retracted to a rearmost position whereas the excavating drive 22 is advanced.

Figure 35:
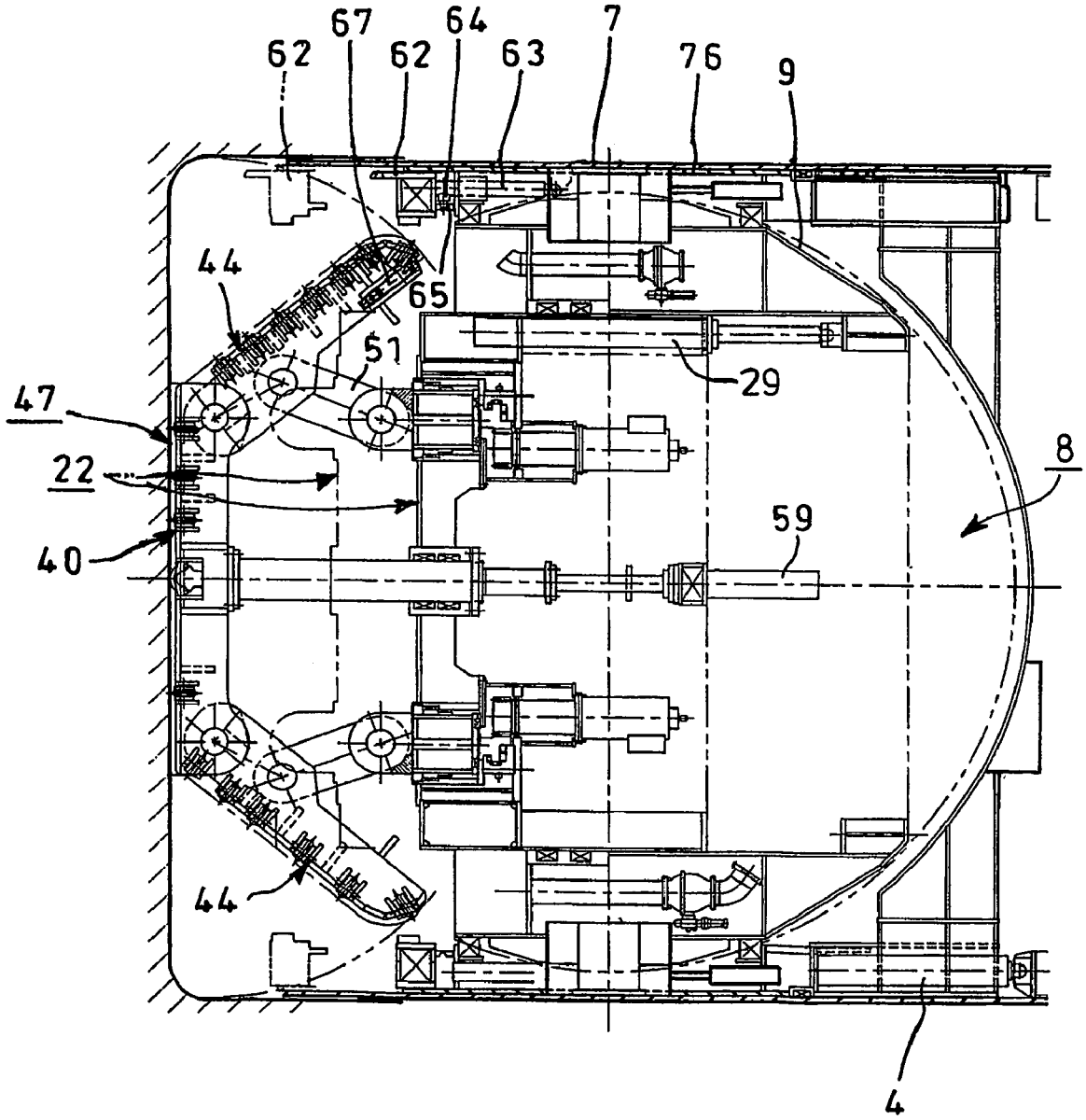
FIG. 35 is a side view in section showing a state of the center cutter of FIG. 34 being advanced while the excavating drive is retracted to contract the cutter device.

Next, as shown in FIG. 35, in order to leave the center cutter 40 at the forefront position where tunneling is halted, the thrust jack 59 is expanded in phase with contraction of the sliding jacks 29 to relatively move the excavating drive 22 and the center cutter 40 away from each other. This causes the expansion cutters 44 to be pivoted backward through the link beams 51 for contraction of the assembly thereof; upon such contraction of the assembly of the expansion cutters 44, the cutters 44 are not interfered with the peripheral ring 62 since the latter is in the retracted position together with the inner cylinder 76. The expansion cutters 44 can be pivoted back with no hindrance for contraction of the assembly thereof since, as shown in FIG.

17, the side protrusion 54 on each of the expansion cutters 44 is overlapped behind the adjacent expansion cutter 44.

Figure 36:
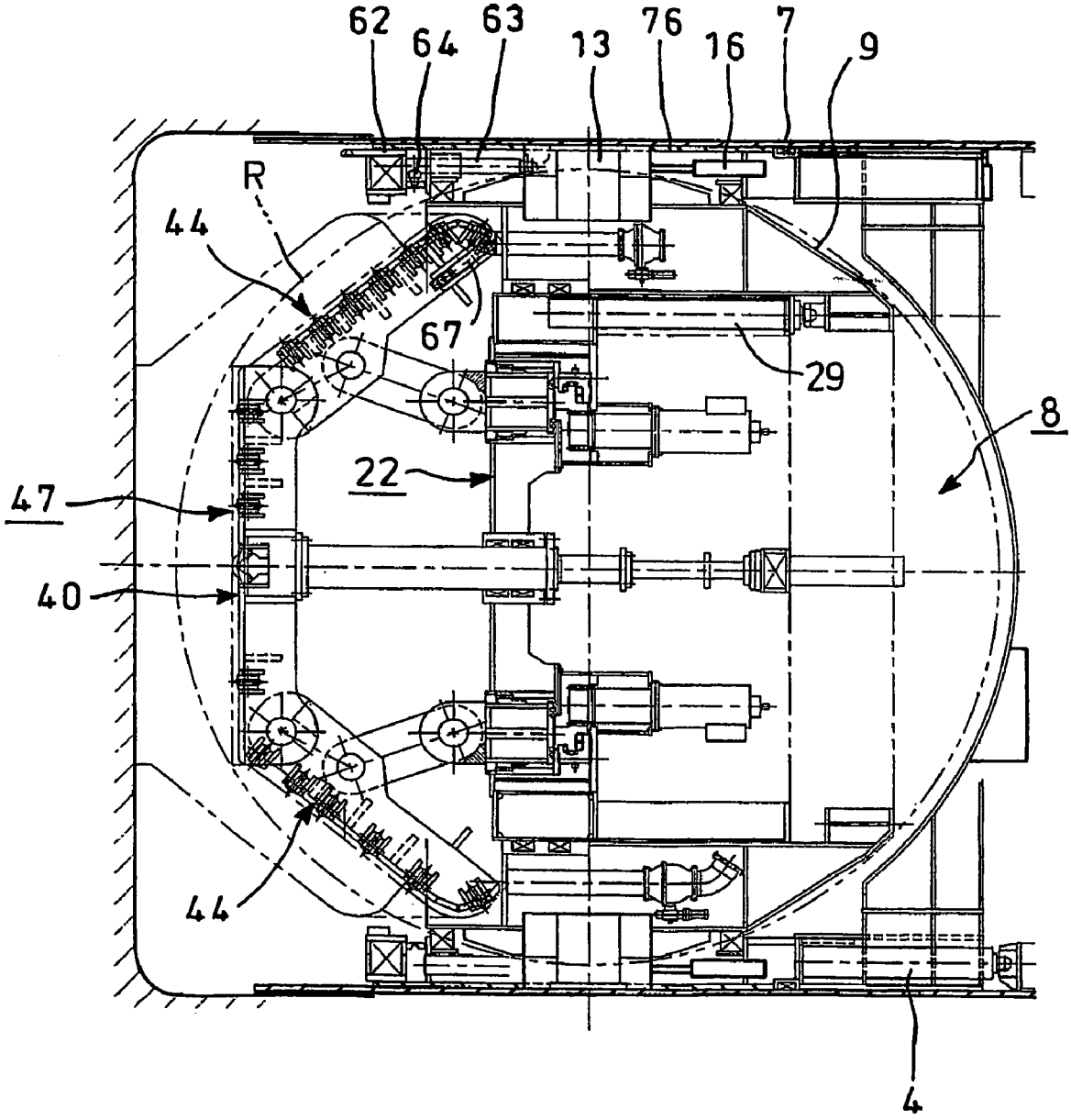
FIG. 36 is a side view in section showing the cutter device of FIG. 35 in a state of being accommodated in the turnable body.

Then, the sliding jacks 29 are contracted to retract the excavating drive 22 with a result that, as shown in FIG. 36, the cutter device 47 is accommodated in the turning trajectory R of the turnable body 9.

Figure 37:
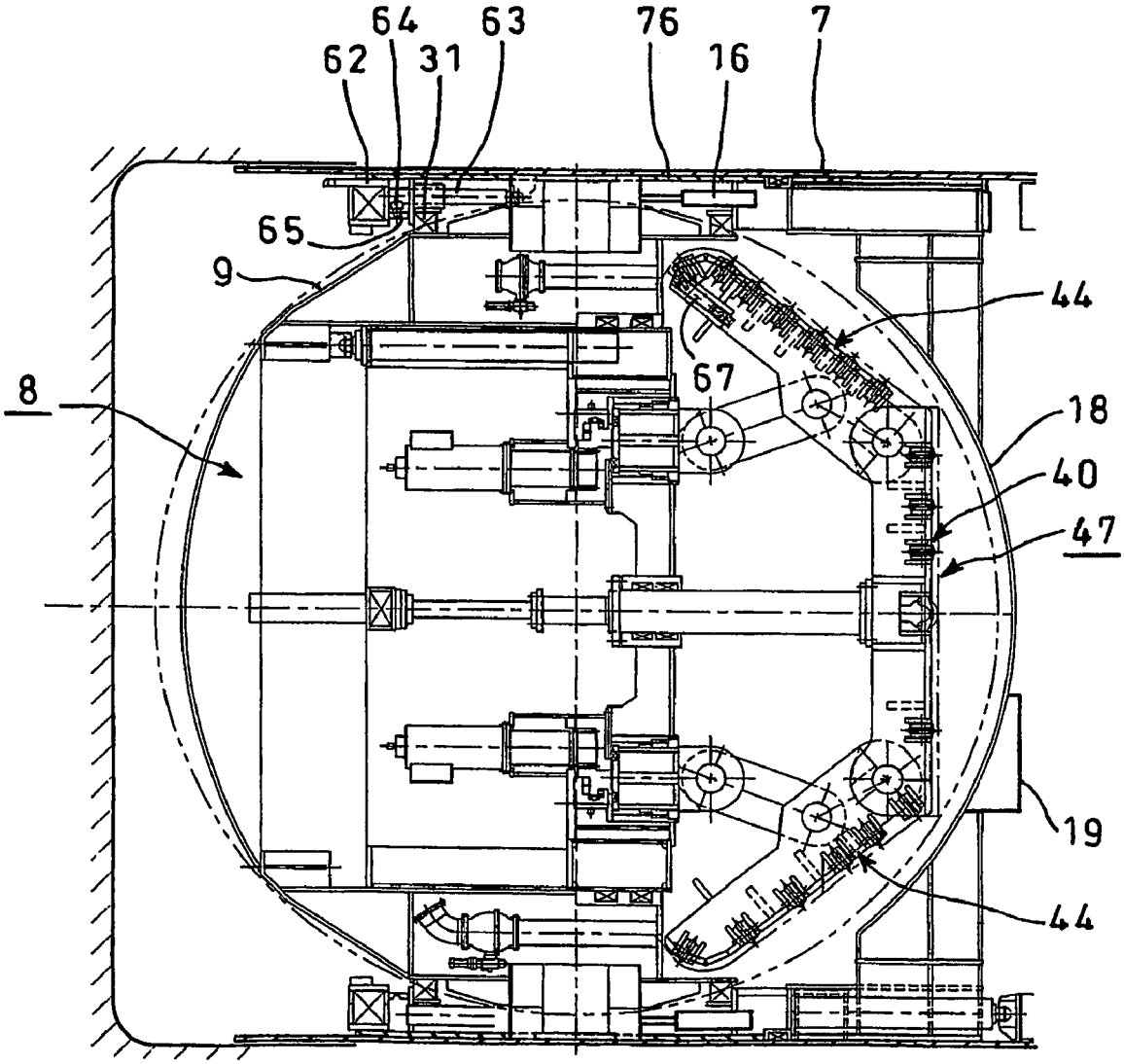
FIG. 37 is a side view in section showing the turnable body of FIG. 36 in a state of being turned to direct the cutter device backward.

Then, the jacks 16 shown above and below in FIG. 3 or 36 are actuated to turn the body 9 around the shafts 13 by 180° so that the cutter device 47 is directed backward as shown in FIG. 37.

During turning of the turnable body 9, contact between the turnable body 9 and the seal 31 is once released, resulting in intrusion of ground water into backward of the turnable body 9; however, completion of the turning by 180° will bring about re-contact and re-sealing between the turnable body 9 and the seal 31. Thus, the ground water intruding into between the turnable body 9 and the bulkhead 18 is discharged through the work port 19 to dry the rear of the cutter device 47. Then, an operator enters forward of the bulkhead 18 through the work port 19 and replaces the damaged bits 35 and 35' on the cutter device 47 in a dry environment. In this chance, for example, repair of the cutters 40 and 44 may be carried out.

After the replacement of the damaged bits 35 and 35' on the cutter device 47, the turnable body 9 is turned in a manner reverse to that described above with respect to FIGS. 34 through 37 to re-direct the cutter device 47 forward; then, the assembly of the expansion cutters 44 is expanded into the state shown in FIG. 29 again for tunneling.

As described above, arranged in the skin plate 7 is the inner cylinder 76 which is movable backward/forward by the shield jacks 4 and which can advance the skin plate 7 in unison upon the advancement thereof, the turnable body 9 being arranged in the inner cylinder 76. The inner cylinder 76 serves to ensure through its retraction a space for contraction of the assembly of the face plate type expansion cutters 44. As a result, even in a case where tunneling by the shield tunneling machine is failed due to the damaged bits 35 and 35' on the cutter device 47, the cutter device 47 can be contracted to be reliably accommodated in the turnable body 9, without a precedent tunneling operation or retraction of the skin plate, so as to direct the cutter device 47 backward for replacement of the damaged bit 35 and 35'. Thus, the shield tunneling machine can be reliable reestablished for long-distance tunneling.

It is to be understood that the present invention is not limited to the above embodiments and that type of the shield body, the turning mode of the turnable body and the contraction mode of the face plate type expansion cutter may be modified variously.

INDUSTRIAL APPLICABILITY

According to the invention, a cutter device, which is of a face plate type, can be contracted into a size accommodable in a turnable body, the turnable body with the cutter device accommodated therein being turned about an axis perpendicular to an axis of the shield body so as to direct the cutter device backward for replacement of damaged bits on the cutter device backward in a dry environment, ensuring safe and efficient replacement of the bits. Long-distant tunneling can be therefore effected to various grounds, using such face plate type cutter device with damaged bits thereon being replaced halfway of tunneling.

What is claimed is:

1. A shield tunneling method wherein a turnable body is arranged in a skin plate so as to be turned about an axis perpendicular to an axis of the skin plate, an excavating drive with a rotor being arranged in said turnable body so as to be movable backward/forward, a cutter device being ahead of said rotor of said excavating drive and being accommodable in the turnable body, the turnable body with the cutter device accommodated therein being turnable to direct the cutter device backward for replacement of damaged bits on the cutter device backward, characterized in that said cutter device comprises a center cutter supported by the excavating drive and a plurality of face plate type expansion cutters fitted to an outer periphery of said center cutter such that the cutters may be pivoted backward/forward, tunneling being effected by the cutter device with an assembly of the expansion cutters being expanded due to the expansion cutters pivoted forward, replacement of the damaged bits being effected such that the expansion cutters are pivoted backward to contract the assembly of the cutters into a size accommodable in a turning trajectory of the turnable body; and then the turnable body is turned to direct the cutter device backward for replacement of the damaged bits.

2. The method according to claim 1 wherein the expansion cutters on said cutter device are connected to the rotor of the excavating drive via bilaterally pivotal expansion drives, tunneling being effected such that the assembly of the expansion cutters is expanded in size with the cutters being pivoted forward by expanding the expansion drives, replacement of the damaged bits being effected such that the excavating drive is advanced relative to the turnable body to effect a precedent tunneling operation into a forefront position by the cutter device for assurance of a space for turning of the turnable body; the expansion drives are contracted at the forefront position for contraction of the assembly of the expansion cutters without interference with a front end of the skin plate; the excavating drive is retracted to accommodate the cutter device in the turning trajectory of the turnable body; and then the turnable body is turned to direct the cutter device backward for replacement of the damaged bits.

3. The method according to claim 1 wherein the expansion cutters on said cutter device are connected to the rotor of the excavating drive via bilaterally pivotal link beams, tunneling being effected such that the assembly of the expansion cutters is expanded in size with the cutters being pivoted forward by the link beams with the center cutter being constrained in position adjacent to the excavating drive, replacement of the damaged bits being effected such that the excavating drive is advanced relative to the turnable body to effect a precedent tunneling operation into a forefront position by the cutter device for assurance of a space for turning of the turnable body; the center cutter is advanced in phase with retraction of the excavating drive so as to retain the center cutter at the forefront position, whereby the assembly of the expansion cutters is contracted via the link beams without interference with a front end of the skin plate; the excavating drive is retracted to accommodate the cutter device in the turning trajectory of the turnable body; and then the turnable body is turned to direct the cutter device backward for replacement of the damaged bits.

4. The method according to claim 1 wherein the skin plate has therein an inner cylinder which is movable backward/forward and which can advance the skin plate in unison with the advancement thereof, the inner cylinder having therein said turnable body which is turnable about an axis perpendicular to an axis of the skin plate, the expansion cutters on said cutter device being connected to the rotor of the excavating drive via bilaterally pivotal link beams, a peripheral ring being arranged between a front end of the inner cylinder and outer peripheries of the expansion cutters so as to be movable backward/forward, tunneling being effected such that the assembly of the expansion cutters is expanded in size with the cutters being pivoted forward by the link beams with the center cutter being constrained in position adjacent to the excavating drive; and an outer periphery of said expanded assembly of the expansion cutters is connected to said peripheral ring which is advanced from the inner cylinder which in turn is also advanced, the peripheral ring being disconnected from the inner cylinder, replacement of the damaged bits being effected such that the peripheral ring is disconnected from the outer periphery of the assembly of the expansion cutters, is retracted and is connected to the inner cylinder; the excavating drive is advanced while the inner cylinder is retracted, thereby retaining the cutter device at a forefront position of tunneling; the center cutter is advanced while the inner cylinder and the excavating drive are retracted, thereby retaining the center cutter at the forefront position, so that the assembly of the expansion cutters is contracted via the link beams without interference with a front end of the skin plate and with the peripheral ring; the excavating drive is retracted to accommodate the cutter device in the turning trajectory of the turnable body; and then the turnable body is turned to direct the cutter device backward for replacement of the damaged bits.

5. A shield tunneling machine comprising a turnable body turnable about an axis perpendicular to an axis of and in a skin plate, an excavating drive movable backward/forward within said turnable body by sliding jacks, and a cutter device ahead of a rotor of the excavating drive, said cutter device comprising a center cutter fixed to the rotor of the excavating drive, a plurality of face plate type expansion cutters fitted to an outer periphery of said center cutter such that the expansion cutters may be pivoted backward/forward, and expansion drives for connecting the expansion cutters to the rotor of the excavating drive.

6. A shield tunneling machine according to claim 5 wherein the expansion cutters may be pivoted backward-!forward about a pivot shaft.

7. A shield tunneling machine comprising a turnable body turnable about an axis perpendicular to an axis of and in a skin plate, an excavating drive movable backward/forward within said turnable body by sliding jacks, and a cutter device ahead of a rotor of the excavating drive, said cutter device comprising a center cutter supported via a center shaft by the rotor of the excavating drive so as to be movable backward/forward, a plurality of face plate type expansion cutters fitted to an outer periphery of said center cutter such that the expansion cutters may be pivoted backward/forward, and link beams for connecting the expansion cutters to the rotor of the excavating drive.

8. A shield tunneling machine according to claim 7 wherein the excavating drive has a thrust jack for pushing said center shaft forward.

9. A shield tunneling machine according to claim 7 further comprising a spacer fitted over said center shaft to constrain the cutter device in position adjacent to the excavating drive.

10. A shield tunneling machine according to claim 7 further comprising abutment members abutting on the link beams to prevent the expansion cutters from being pivoted backward when the expansion cutters are pivoted forward for expansion of the assembly of the cutters.

11. A shield tunneling machine according to claim 7 wherein each of the expansion cutters has connectors each of which extends to the adjacent expansion cutter for connection with the corresponding connector of the latter through mutual engagement therebetween.

12. A shield tunneling machine according to claim 7 wherein each of said expansion cutters has a side protrusion which extends to the adjacent expansion cutter to provide together with the latter a narrow take-in slot when the assembly of the expansion cutters is expanded, the side protrusion being arranged to be overlapped behind the adjacent expansion cutter without mutual interference when the assembly of the expansion cutters is contracted.

13. A shield tunneling machine according to claim 7 wherein arranged ahead of said skin plate is a peripheral ring which is movable backward/forward, said peripheral ring being capable of being connected to and disconnected from the outer peripheries of the expansion cutters when the assembly thereof is expanded, said peripheral ring being capable of being connected to and disconnected from the skin plate.

14. A shield tunneling machine according to claim 13 further comprising thrust jacks on an inner surface of the skin plate for moving the peripheral ring backward/forward.

15. A shield tunneling machine according to claim 7 wherein the expansion cutters may be pivoted backward/forward about a pivot shaft.

16. A shield tunneling machine comprising an inner cylinder which is arranged in a skin plate for movement backward/forward by shield jacks and which can advance the skin plate in unison upon advancement thereof, a turnable body arranged in said inner cylinder so as to be turned about an axis perpendicular to an axis of the skin plate, an excavating drive arranged in said turnable body so as to be movable backward/forward by sliding jacks, a cutter device arranged ahead of the rotor of said excavating drive, said cutter device comprising a center cutter supported via a center shaft by the rotor of the excavating drive so as to be movable backward/forward, a plurality of face plate type expansion cutters fitted to an outer periphery of said center cutter such that the cutters may be pivoted backward/forward, and link beams connecting the expansion cutters to the rotor of the excavating drive, and a peripheral ring arranged ahead of said inner cylinder so as to movable backward/forward, said peripheral ring being capable of being connected to and disconnected from outer peripheries of the expansion cutters when the assembly of the expansion cutters is expanded, said peripheral ring being capable of being connected to and disconnected from the inner cylinder.

17. A shield tunneling machine according to claim 16 wherein said inner cylinder has a locking part for advancing the skin plate in unison with advancement of said inner cylinder.

18. A shield tunneling machine according to claim 16 further comprising fixtures each for fixing a jack shoe of a corresponding shield jack to the corresponding segment.

19. A shield tunneling machine according to claim 16 wherein said excavating drive has a thrust jack for pushing said center shaft forward.

20. A shield tunneling machine according to claim 16 wherein a spacer is fitted over said center shaft so as to constrain the cutter device in position adjacent to the excavating drive.

21. A shield tunneling machine according to claim 16 further comprising thrust jacks on an inner surface of the skin plate for moving the peripheral ring backward/forward.

22. A shield tunneling machine according to claim 16 further comprising abutment members abutting on the link beams for preventing the expansion cutters from being pivoted backward when the expansion cutters are pivoted forward for expansion of the assembly thereof.

23. A shield tunneling machine according to claim 16 wherein each of the expansion cutters has connectors each of which extends to the adjacent expansion cutter for connection with the corresponding connector of the latter through mutual engagement therebetween.

24. A shield tunneling machine according to claim 16 wherein each of said expansion cutters has a side protrusion which extends to the adjacent expansion cutter to provide together with the latter a narrow take-in slot when the assembly of the expansion cutters is expanded, the side protrusion being arranged to be overlapped behind the adjacent expansion cutter without mutual interference when the assembly of the expansion cutters is contracted.

* * * * *

UNITED STATES PATENT AND TRADEMARK OFFICE

CERTIFICATE OF CORRECTION

PATENT NO. : 7,040,712 B2
APPLICATION NO. : 10/470435
DATED : May 9, 2006
INVENTOR(S) : Sakae et al.

It is certified that error appears in the above-identified patent and that said Letters Patent is hereby corrected as shown below:

On the title page, Item (30), the 3rd Foreign Application Priority Data information is incorrect. Item (30) should read:

-- (30) Foreign Application Priority Data

Jul. 23, 2001 (JP) ..... 2001-221872
Jul. 23, 2001 (JP) ..... 2001-221874
Feb. 22, 2002 (JP) ..... 2002-046720 --

Signed and Sealed this

Fifth Day of September, 2006

JON W. DUDAS
*Director of the United States Patent and Trademark Office*